US006949498B2

(12) United States Patent
Murphy et al.

(10) Patent No.: US 6,949,498 B2
(45) Date of Patent: Sep. 27, 2005

(54) LAUNDRY CLEANSING AND CONDITIONING COMPOSITIONS

(75) Inventors: Dennis Stephen Murphy, Wyckoff, NJ (US); Michael Orchowski, East Rutherford, NJ (US); Alla Tartakovsky, West Orange, NJ (US); David Alan Binder, Saddle Brook, NJ (US)

(73) Assignee: Unilever Home & Personal Care USA a division of Conopco, Inc., Greenwich, CT (US)

( * ) Notice: Subject to any disclaimer, the term of this patent is extended or adjusted under 35 U.S.C. 154(b) by 105 days.

(21) Appl. No.: 10/446,202

(22) Filed: May 27, 2003

(65) Prior Publication Data

US 2004/0152617 A1 Aug. 5, 2004

Related U.S. Application Data

(63) Continuation-in-part of application No. 10/357,248, filed on Feb. 3, 2003, now abandoned.

(51) Int. Cl.[7] ..... C11D 1/04; C11D 1/12; C11D 1/38; C11D 3/37; D06L 1/02

(52) U.S. Cl. ..... 510/327; 510/329; 510/330; 510/351; 510/357; 510/426; 510/475; 8/137

(58) Field of Search ..... 510/327, 329, 510/330, 351, 357, 426, 475; 8/137

(56) References Cited

U.S. PATENT DOCUMENTS

| | | | | |
|---|---|---|---|---|
| 3,472,840 | A | 10/1969 | Stone et al. | |
| 4,144,226 | A | 3/1979 | Crutchfield et al. | |
| 4,146,495 | A | 3/1979 | Crutchfield et al. | |
| 4,299,817 | A | 11/1981 | Hannan, III et al. | |
| 4,686,062 | A | 8/1987 | Kermode et al. | |
| 4,844,821 | A | 7/1989 | Mermelstein et al. | |
| 4,913,828 | A | 4/1990 | Caswell et al. | |
| 5,073,274 | A | 12/1991 | Caswell | |
| 5,733,854 | A | 3/1998 | Robinson et al. | |
| 6,369,018 | B1 | 4/2002 | Hsu et al. | |
| 6,461,387 | B1 | 10/2002 | Jureller et al. | |
| 6,492,322 | B1 | 12/2002 | Cooper et al. | |
| 6,620,209 | B2 * | 9/2003 | Kischkel et al. | 8/137 |
| 6,727,220 | B1 * | 4/2004 | Grainger et al. | 510/475 |
| 2002/0055451 | A1 | 5/2002 | Kischkel et al. | |
| 2002/0058604 | A1 | 5/2002 | Kischkel et al. | |
| 2002/0151454 | A1 | 10/2002 | Kischkel et al. | |
| 2002/0155981 | A1 | 10/2002 | Kischkel et al. | |
| 2002/0169097 | A1 | 11/2002 | Kasturi et al. | |

FOREIGN PATENT DOCUMENTS

| | | |
|---|---|---|
| EP | 1 191 094 A2 | 3/2002 |
| WO | 98/04239 | 2/1998 |
| WO | 98/04241 | 2/1998 |
| WO | 98/16538 | 4/1998 |
| WO | 00/70005 | 11/2000 |
| WO | 01/07546 | 2/2001 |
| WO | 01/19946 | 3/2001 |
| WO | 03/095497 | 11/2003 |

OTHER PUBLICATIONS

Lockhead, R.Y., et al, *Encyclopedia of Polymers and Thickeners for Cosmetics, Cosmetics and Toiletries*, vol. 108, 95–138, (May 1993).

*International Cosmetic Ingredient Dictionary, Monographs*, 569–574, No Date Given.

Bluestein, B.R., et al., *Cationic Surfactants Organic Chemsitry*, 52–53, (1982), No Month Given.

Rubingh, Donn N. et al., *Cationic Surfactants Physical Chemistry*, vol. 37, 2–5, 496–497, (1991), No Month Given.

Rita Corporation Technical Data Sheet of Rita Polyquat 125, dated Jul. 24, 1998.

Derwent WPI acc. No. 2002–455549/200249 Abstract of EP 1 191 094 A2—1 page.

International Search Report No. PCT/EP2004/000668 dated Jun. 9, 2004, 4 pp.

* cited by examiner

*Primary Examiner*—Brian P. Mruk
(74) *Attorney, Agent, or Firm*—Ellen Plotkin

(57) ABSTRACT

Fabric and textile conditioning compositions containing particular combinations of cationic polymers and anionic surfactants are disclosed. The polymers are soluble or dispersible to at least 0.01% by weight in distilled water at 25° C., are preferably below a particular molecular weight to afford optimal cleaning and conditioning, and must be present in an effective amount to yield a substantial conditioning benefit. A method of conditioning articles using the polymer/surfactant combinations is also disclosed.

25 Claims, No Drawings

LAUNDRY CLEANSING AND CONDITIONING COMPOSITIONS

This application is a Continuation-in-Part of U.S. patent application Ser. No. 10/357,248, filed Feb. 3, 2003 now abandoned.

FIELD OF THE INVENTION

This invention relates to laundry conditioning compositions. More particularly, the invention is directed to laundry compositions containing at least one cationic polymer and at least one anionic surfactant that deliver an unexpected level of fabric softening.

BACKGROUND OF THE INVENTION

Textile fabrics, including clothes, have traditionally been cleaned with laundry detergents. After cleaning, fabrics can often feel harsh and they will wear and lose color over repeat wash cycles. To prevent the drawbacks of fabrics feeling harsh after cleaning and those experienced by multiple wash cycles, technologies have been developed including rinse conditioners, softening detergents and anti-dye transfer agents.

However, existing technologies still do not fully prevent such fabric cleaning drawbacks. Thus, there is an ongoing need for products that will condition and protect fabrics from the effects of the washing process.

We have surprisingly found that certain cationic polymer and anionic surfactant mixtures provide excellent conditioning to laundered fabrics.

OTHER INFORMATION

Softening laundry detergent compositions have been disclosed in U.S. Pat. Appl. Nos. 2002/0151454 and 2002/0155981.

Softening laundry detergent tablet compositions have been disclosed in U.S. Pat. Appl. Nos. 2002/0055451 and 2002/0058604.

Softening liquid laundry detergent compositions have been disclosed in U.S. Pat. No. 4,844,821.

A process for producing suspending liquid laundry detergents has been disclosed in Hsu, U.S. Pat. No. 6,369,018. Hsu discloses the use of polymer JR in an anionic-surfactant containing liquid detergent and further requires a polysaccharide polymer such as xanthan gum, which leads to an unstable product.

Hair conditioning and shampoo art has been disclosed in U.S. Pat. Nos. 3,472,840 and 4,299,817 and WO 98/04241 and 98/04239.

Washer added fabric softening compositions have been disclosed in U.S. Pat. Nos. 4,913,828 and 5,073,274.

Fabric softener compositions have been disclosed in WO 00/70005 and U.S. Pat. No. 6,492,322.

Liquid detergent compositions comprising polymeric suds enhancers have been disclosed in U.S. Pat. Appl. No. 2002/0169097.

Although U.S. Pat. Nos. 4,913,828; 5,073,274; and 4,844,821; and, WO 00/70005 teach softening laundry compositions, they all contain insoluble material that will scatter light and render the compositions non-transparent and the percent transmittance will be less than 50. When the insoluble material is solid, the composition is considered to be a suspension and when it is liquid, the composition is considered to be an emulsion.

SUMMARY OF THE INVENTION

In a first aspect, this invention is directed to a liquid laundry composition consisting essentially of one or more cationic polymers and one or more anionic surfactants wherein the composition has a percent transmittance of greater than about 50 at 570 nanometers measured in the absence of dyes and contains less than about 2% anionic polysaccharide.

Preferably, this invention is directed to a laundry composition comprising one or more cationic polymers and more than about 5% of one or more anionic surfactants having an HLB of greater than about 4 wherein the softening parameter is greater than 40 and one or more of the the cationic polymers has a molecular weight of less than about 850,000 daltons. The composition can take many forms including liquid, powder, paste, granule, molded solid or water soluble sheet.

In a second aspect, this invention is directed to a laundry composition comprising one or more cationic polymers and more than about 5% of one or more anionic surfactants having an HLB of greater than about 4 wherein the softening parameter is greater than about 40.

In a third aspect, this invention is directed to a powdered laundry composition comprising of one or more cationic polymers and one or more anionic surfactants wherein one or more of the cationic polymers has a dissolution parameter of 55 or greater, and more than about 5% of one or more anionic surfactants having an HLB of greater than about 4 wherein the softening parameter is greater than about 40.

In a fourth aspect, this invention is directed to a method for conditioning textiles comprising, in no particular order, the steps of:

a. providing a laundry detergent or fabric softener composition comprising at least one anionic surfactant and at least one cationic polymer, in a ratio and concentration to effectively soften and condition fabrics under predetermined laundering conditions;

b. contacting one or more articles with the composition at one or more points during a laundering process; and c. allowing the articles to dry or mechanically tumble-drying them.

In the preferred method, the softening parameter is greater than 40 and the composition comprises more than about 5% by weight of one or more anionic surfactants having an HLB of greater than about 4, and one or more of said cationic polymers have a molecular weight of less than about 850,000 daltons

DETAILED DESCRIPTION OF THE INVENTION

As used herein, the term "comprising" means including, made up of, composed of, consisting and/or consisting essentially of.

Except in the operating and comparative examples, or where otherwise explicitly indicated, all numbers in this description indicating amounts or ratios of material or conditions of reaction, physical properties of materials and/or use are to be understood as modified by the word "about".

As used herein, a formula shall be considered physically "stable" when after 1 week at 21 degrees Celsius it exhibits no signs of phase separation.

The present invention is directed to laundry compositions containing mixtures of one or more anionic surfactant and one or more cationic polymer that deliver an unexpectedly high level of conditioning to fabrics. The main objective of this invention is to render garments more pleasant to the touch, and provide other conditioning benefits. Preferably, the compositions of the present invention yield softening parameters of greater than 40. Also, the inventive compositions have a percent transmittance of greater than about 50 at 570 nanometers measured in the absence of dyes and contain less than about 2% anionic polysaccharide.

Conditioning Benefits

The compositions of this invention are intended to confer conditioning benefits to garments, home textiles, carpets and other fibrous or fiber-derived articles. These formulations are not to be limited to conditioning benefits, however, and will often be multi-functional. As such, in addition to conditioning fiber-derived articles, they may also clean, fragrance or otherwise treat them.

The primary conditioning benefit afforded by these products is softening. Softening includes, but is not limited to, an improvement in the handling of a garment treated with the compositions of this invention relative to that of an article laundered under identical conditions but without the use of this invention. Consumers will often describe an article that is softened as "silky" or "fluffy", and generally prefer the feel of treated garments to those that are unsoftened. It is desirable that the formulae of this invention, when used as instructed, yield a softness parameter of more than 40. The preferred products give a softness parameter in excess of 55, however, while even more preferred products give a softness parameter of more than 70. Given the large amount of softening-in-the-wash related prior art that has attempted to reach this level of softening unsuccessfully, it is quite surprising that the products of this invention are often so efficacious. In order to attain the desired level of softening, it is preferred that the composition contain greater than about 5% anionic surfactant.

The conditioning benefits of these compositions are not limited to softening, however. They may, depending on the particular embodiment of the invention selected, also provide an antistatic benefit. In addition to softening, the cationic polymer/anionic surfactant compositions of this invention are further believed to lubricate the fibers of textile articles, which can reduce wear, pilling and color fading, and provide a shape-retention benefit. This lubricating layer may also, without wishing to be bound by theory, provide a substrate on the fabric for retaining fragrances and other benefit agents. Furthermore, the cationic polymers of this invention are also believed to inhibit the transfer, bleeding and loss of vagrant dyes from fabrics during the wash, further improving color brightness over time.

Form of the Invention

The present invention can take any of a number of forms. It can take the form of a dilutable fabric conditioner, that may be an isotropic liquid, a surfactant-structured liquid, a granular, spray-dried or dry-blended powder, a tablet, a paste, a molded solid or any other laundry detergent form known to those skilled in the art. A "dilutable fabric conditioning" composition is defined, for the purposes of this disclosure, as a product intended to be used by being diluted with water or a non-aqueous solvent by a ratio of more than 100:1, to produce a liquor suitable for treating textiles and conferring to them one or more conditioning benefits. Water soluble sheets or sachets, such as those described in U.S. Pat. Appl. No. 20020187909, which is incorporated herein by reference, are also envisaged as a potential form of this invention. These may be sold under a variety of names, and for a number of purposes. As such, compositions intended to be used as combination detergent/softeners, along with fabric softeners sold for application in the final rinse of a wash cycle and fabric softeners sold for application at the beginning of a wash cycle are all considered within the scope of this invention. For all cases, however, these compositions are intended to be used by being diluted by a ratio of more than 100:1 with water or a non-aqueous solvent, to form a liquor suitable for treating fabrics.

Particularly preferred forms of this invention include combination detergent/softener products, especially as a liquid or powder, and isotropic or surfactant-structured liquid products intended for application as a fabric softener during the wash cycle or the final rinse. For the purposes of this disclosure, the term "fabric softener" shall be understood to mean a consumer or industrial product added to the wash, rinse or dry cycle of a laundry process for the express or primary purpose of conferring one or more conditioning benefits.

It can also take the form of a fabric softener intended to be applied to articles without substantial dilution and sold as any form known to those skilled in the art as a potential medium for delivering such fabric softeners to the consumer. Examples of such forms include dryer sheets, dryer puffs, dispensing devices intended to be fastened to the interior of a consumer's electric, gas or microwave dryer and the like. Sprays, such as aerosol or pump sprays, for direct application to fabrics are also considered within the scope of this disclosure. Such examples, however, are provided for illustrative purposes and are not intended to limit the scope of this invention.

The preferred pH range of the composition is 2–12. Because many cationic polymers can decompose at high pH, especially when they contain amine or phosphine moieties, it is desirable to keep the pH of the composition below the $pK_a$ of the amine or phosphine group that is used to quaternize the selected polymer, below which the propensity for this to occur is greatly decreased. This reaction can cause the product to lose effectiveness over time and create an undesirable product odor. As such, a reasonable margin of safety, of 1–2 units of pH below the $pK_a$ should ideally be used in order to drive the equilibrium of this reaction to strongly favor polymer stability. Although the preferred pH of the product will depend on the particular cationic polymer selected for formulation, typically these values should be below about 8.5 to 10. Wash liquor pH, especially in the case of powdered softener and combination detergent/softener products, can often be less important, as the kinetics of polymer decomposition are often slow, and the time of one wash cycle is typically not sufficient to allow for this reaction to have a significant impact on the performance or odor of the product. A lower pH can also aid in the formulation of higher-viscosity products.

Conversely, as the product depends on the presence of soluble anionic surfactants to provide softening, its pH should preferably be above the $pK_a$ of the surfactant acids used to formulate it. In addition, aqueous detergent products, which are a highly preferred embodiment of this invention, are nearly impossible to formulate below the $pK_a$ of the surfactant acids used, as these molecules are rather insoluble in water when in acid form. Again, it is especially desirable to have the pH at least 1–2 units above the $pK_a$ of the surfactant acids, to ensure that the vast majority of anionic surfactant is present in salt form. Typically, this will suggest that the product pH should be above about 4, although in certain cases, such as when carboxylic acid salts, which often have a $pK_a$ around 4 or 5, are used, the pH of the product can need to be above about 7 or 8 to ensure effective softening.

It is desirable to buffer the formulation at whatever the target pH of the composition is.

Method of Use

The following details a method for conditioning textiles comprising the steps, in no particular order of:

a. providing a laundry detergent or fabric softener composition comprising at least one anionic surfactant and at least one cationic polymer, in a ratio and concentration to effectively soften and condition fabrics under predetermined laundering conditions;

b. contacting one or more articles with the composition at one or more points during a laundering process; and c. allowing the articles to dry or mechanically tumble-drying them, wherein the softening parameter is greater than 40 and the composition comprises more than about 5% by weight of one or more anionic surfactants having an HLB of greater than about 4.

Amounts of composition used will generally range between about 10 g and about 300 g total product per 3 kg of conditioned fibrous articles, depending on the particular embodiment chosen and other factors, such as consumer preferences, that influence product use behavior.

A consumer that would use the present invention could also be specifically instructed to contact the fabrics with the inventive composition with the purpose of simultaneously cleaning and softening the said fabrics. This approach would be recommended when the composition takes the form of a softening detergent to be dosed at the beginning of the wash cycle.

Insoluble Matter

It is preferred that the compositions of this disclosure be formulated with low levels, if any at all, of any matter that is substantially insoluble in the solvent intended to be used to dilute the product. For the purposes of this disclosure, "substantially insoluble" shall mean that the material in question can individually be dissolved at a level of less than 0.001% in the specified solvent. Examples of substantially insoluble matter in aqueous systems include, but are not limited to aluminosilicates, pigments, clays and the like. Without wishing to be bound by theory, it is believed that solvent-insoluble inorganic matter can be attracted and coordinated to the cationic polymers of this invention, which are believed to attach themselves to the articles being washed. When this occurs, it is thought that these particles can create a rough effect on the fabric surface, which in turn reduces the perception of softness.

In addition, as liquid compositions are a preferred embodiment of this invention, and insoluble matter is often difficult to formulate into a liquid, it is further desirable to minimize its level in the product. For this invention it is desirable to have the liquid compositions be substantially transparent for esthetic reasons. Thus, for the compositions of this invention it is desirable to have a percent transmittance of light of greater than about 50 using a 1 centimeter cuvette at a wavelength of 570 nanometers wherein the composition is measured in the absence of dyes. Alternatively, transparency of the composition may be measured as having an absorbence (A) at 570 nanometers of less than about 0.3 which is in turn equivalent to percent transmittance of greater than about 50 using the same cuvette as above. The relationship between absorbance and percent transmittance is:

$$\text{Percent Transmittance}=100(1/\text{inverse log } A)$$

Preferably, insoluble and substantially insoluble matter will be limited to less than 10% of the composition, more preferably 5%. Most preferably, especially in the case of liquid conditioning compositions, the composition will be essentially free of substantially insoluble matter.

Anionic Surfactants

The anionic surfactants used in this invention can be any anionic surfactant that is substantially water soluble. "Water soluble" surfactants are, unless otherwise noted, here defined to include surfactants which are soluble or dispersible to at least the extent of 0.01% by weight in distilled water at 25° C. "Anionic surfactants" are defined herein as amphiphilic molecules with an average molecular weight of less than about 10,000, comprising one or more functional groups that exhibit a net anionic charge when in aqueous solution at the normal wash pH of between 6 and 11. It is preferred that at least one of the anionic surfactants used in this invention be an alkali or alkaline earth metal salt of a natural or synthetic fatty acid containing between 4 and 30 carbon atoms. It is especially preferred to use a mixture of carboxylic acid salts with one or more other anionic surfactants. Another important class of anionic compounds are the water soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Carboxylic Acid Salts $$R^1COOM$$

where $R^1$ is a primary or secondary alkyl group of 4 to 30 carbon atoms and M is a solubilizing cation. The alkyl group represented by $R^1$ may represent a mixture of chain lengths and may be saturated or unsaturated, although it is preferred that at least two thirds of the $R^1$ groups have a chain length of between 8 and 18 carbon atoms. Nonlimiting examples of suitable alkyl group sources include the fatty acids derived from coconut oil, tallow, tall oil and palm kernel oil. For the purposes of minimizing odor, however, it is often desirable to use primarily saturated carboxylic acids. Such materials are well known to those skilled in the art, and are available from many commercial sources, such as Uniqema (Wilmington, Del.) and Twin Rivers Technologies (Quincy, Mass.). The solubilizing cation, M, may be any cation that confers water solubility to the product, although monovalent such moieties are generally preferred. Examples of acceptable solubilizing cations for use with this invention include alkali metals such as sodium and potassium, which are particularly preferred, and amines such as triethanolammonium, ammonium and morpholinium. Although, when used, the majority of the fatty acid should be incorporated into the formulation in neutralized salt form, it is often preferable to leave a small amount of free fatty acid in the formulation, as this can aid in the maintenance of product viscosity.

Primary Alkyl Sulfates $$R^2OSO_3M$$

where $R^2$ is a primary alkyl group of 8 to 18 carbon atoms and M is a solubilizing cation. The alkyl group $R^2$ may have a mixture of chain lengths. It is preferred that at least two-thirds of the $R^2$ alkyl groups have a chain length of 8 to 14 carbon atoms. This will be the case if $R^2$ is coconut alkyl, for example. The solubilizing cation may be a range of cations which are in general monovalent and confer water solubility. An alkali metal, notably sodium, is especially envisaged. Other possibilities are ammonium and substituted ammonium ions, such as trialkanolammonium or trialkylammonium.

Alkyl Ether Sulfates $$R^3O(CH_2CH_2O)_nSO_3M$$

where $R^3$ is a primary alkyl group of 8 to 18 carbon atoms, n has an average value in the range from 1 to 6 and M is a solubilizing cation. The alkyl group $R^3$ may have a mixture of chain lengths. It is preferred that at least two-thirds of the $R^3$ alkyl groups have a chain length of 8 to 14 carbon atoms. This will be the case if $R^3$ is coconut alkyl, for example. Preferably n has an average value of 2 to 5. Ether sulfates have been found to provide viscosity build in certain of the formulations of this invention, and thus are considered a preferred ingredient.

Fatty Acid Ester Sulfonates $$R^4CH(SO_3M)CO_2R^5$$

where $R^4$ is an alkyl group of 6 to 16 atoms, $R^5$ is an alkyl group of 1 to 4 carbon atoms and M is a solubilizing cation. The group $R^4$ may have a mixture of chain lengths. Preferably at least two-thirds of these groups have 6 to 12 carbon atoms. This will be the case when the moiety $R^8CH(-)CO_2(-)$ is derived from a coconut source, for instance. It is preferred that $R^5$ is a straight chain alkyl, notably methyl or ethyl.

Alkyl Benzene Sulfonates $$R^6ArSO_3M$$

where $R^6$ is an alkyl group of 8 to 18 carbon atoms, Ar is a benzene ring ($C_6H_4$) and M is a solubilizing cation. The group $R^6$ may be a mixture of chain lengths. A mixture of isomers is typically used, and a number of different grades, such as "high 2-phenyl" and "low 2-phenyl" are commercially available for use depending on formulation needs. A plentitude of commercial suppliers exist for these materials, including Stepan (Northfield, Ill.) and Witco (Greenwich, Conn.) Typically they are produced by the sulfonation of alkylbenzenes, which can be produced by either the HF-catalyzed alkylation of benzene with olefins or an $AlCl_3$-catalyzed process that alkylates benzene with chlorpparaffins, and are sold by, for example, Petresa (Chicago, Ill.) and Sasol (Austin, Tex.). Straight chains of 11 to 14 carbon atoms are usually preferred.

Paraffin sulfonates having 8 to 22 carbon atoms, preferably 12 to 16 carbon atoms, in the alkyl moiety. They are usually produced by the sulfoxidation of petrochemically-derived normal paraffins. These surfactants are commercially available as, for example, Hostapur SAS from Clariant (Charlotte, N.C.).

Olefin sulfonates having 8 to 22 carbon atoms, preferably 12 to 16 carbon atoms. U.S. Pat. No. 3,332,880 contains a description of suitable olefin sulfonates, and is incorporated herein by reference. Such materials are sold as, for example, Bio-Terge AS-40, which can be purchased from Stepan (Northfield, Ill.)

Sulfosuccinate Esters $$R^7OOCCH_2CH(SO_3^-M^+)COOR^8$$

are also useful in the context of this invention. $R^7$ and $R^8$ are alkyl groups with chain lengths of between 2 and 16 carbons, and may be linear or branched, saturated or unsaturated. A preferred sulfosuccinate is sodium bis (2-ethylhexyl) sulfosuccinate, which is commercially available under the tradename Aerosol OT from Cytec Industries (West Paterson, N.J.).

Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Other preferred anionic surfactants include the fatty acid ester sulfonates with formula:

$$R^9CH(SO_3M)CO_2R^{10}$$

where the moiety $R^9CH(-)CO_2(-)$ is derived from a coconut source and $R^{10}$ is either methyl or ethyl; primary alkyl sulfates with the formula:

$$R^{11}OSO_3M$$

wherein $R^{11}$ is a primary alkyl group of 10 to 18 carbon atoms and M is a sodium cation; and paraffin sulfonates, preferably with 12 to 16 carbon atoms to the alkyl moiety.

Other anionic surfactants preferred for use with this formulation include isethionates, sulfated triglycerides, alcohol sulfates, ligninsulfonates, naphthelene sulfonates and alkyl naphthelene sulfonates and the like. Additional anionic surfactants, falling into the general definition but not specifically mentioned above, should also be considered within the scope of this invention.

Water Soluble Cationic Polymer

A water soluble cationic polymer is here defined to include polymers which, because of their molecular weight or monomer composition, are soluble or dispersible to at least the extent of 0.01% by weight in distilled water at 25° C. Water soluble cationic polymers include polymers in which one or more of the constituent monomers are selected from the list of copolymerizable cationic or amphoteric monomers. These monomer units contain a positive charge over at least a portion of the pH range 6–11. A partial listing of monomers can be found in the "International Cosmetic Ingredient Dictionary," 5th Edition, edited by J. A. Wenninger and G. N. McEwen, *The Cosmetic, Toiletry, and Fragrance Association*, Washington D.C., 1993, incorporated herein by reference. Another source of such monomers can be found in "Encyclopedia of Polymers and Thickeners for Cosmetics", by R. Y. Lochhead and W. R. Fron, *Cosmetics & Toiletries*, vol. 108, May 1993, pp 95–135, herein incorporated.

The cationic polymers of this invention are effective at surprisingly low levels. As such, the ratio of cationic polymer to total surfactant in the composition should preferably be no greater than about 1:5, and more preferably less than about 1:10. The ratio of cationic polymer to anionic surfactant in the composition, on a mass basis, should be less than about 1:4, and ideally less than about 1:10, as well. The preferred compositions of this invention contain low levels, if any at all, of builder. Generally, these will comprise less than 10%, preferably less than 7% and most preferably less than 5% by weight of total phosphate and zeolite. Furthermore, it is desirable to minimize the amount of certain types of anionic polymers added to the system, as it is believed, without wishing to be bound by theory, that these molecules can complex with the cationic polymers and have a detrimental effect on softening. The preferred compositions of this disclosure comprise less than 2%, more preferably less than 1% and most preferably less than 0.5% anionic polymer. "Anionic polymer" is defined as a molecule with a molecular weight in excess of about 10,000 daltons comprised of monomer units where at least one of the monomer units making up the polymer contains a negative charge over a portion of the wash pH range of pH 6 to pH 11, those monomer units not containing anionic charges being nonionic in nature.

Specifically, monomers useful in this invention may be represented structurally as etiologically unsaturated compounds as in formula I.

I

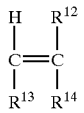

wherein $R^{12}$ is hydrogen, hydroxyl, methoxy, or a $C_1$ to $C_{30}$ straight or branched alkyl radical; $R^{13}$ is hydrogen, or a $C_{1-30}$ straight or branched alkyl, a $C_{1-30}$ straight or branched alkyl substituted aryl, aryl substituted $C_{1-30}$ straight or branched alkyl radical, or a poly oxyalkene condensate of an aliphatic radical; and $R^{14}$ is a heteroatomic alkyl or aromatic radical containing either one or more quaternerized nitrogen atoms or one or more amine groups which possess a positive charge over a portion of the pH interval pH 6 to 11. Such amine groups can be further delineated as having a $pK_a$ of about 6 or greater.

Examples of cationic monomers of formula I include, but are not limited to, co-poly 2-vinyl pyridine and its co-poly 2-vinyl N-alkyl quaternary pyridinium salt derivatives; co-poly 4-vinyl pyridine and its co-poly 4-vinyl N-alkyl quaternary pyridinium salt derivatives; co-poly 4-vinylbenzyltrialkylammonium salts such as co-poly 4-vinylbenzyltrimethylammonium salt; co-poly 2-vinyl piperidine and co-poly 2-vinyl piperidinium salt; co-poly 4-vinylpiperidine and co-poly 4-vinyl piperidinium salt; co-poly 3-alkyl 1-vinyl imidazolium salts such as co-poly 3-methyl 1-vinyl imidazolium salt; acrylamido and methacrylamido derivatives such as co-poly dimethyl aminopropylmethacrylamide, co-poly acrylamidopropyl trimethylammonium salt and co-poly methacrylamidopropyl trimethylammonium salt; acrylate and methacrylate derivatives such as co-poly dimethyl aminoethyl (meth)acrylate, co-poly ethanaminium N,N,N trimethyl 2-[(1-oxo-2 propenyl) oxy]-salt, co-poly ethanaminium N,N,N trimethyl 2-[(2 methyl-1-oxo-2 propenyl) oxy]-salt, and co-poly ethanaminium N,N,N ethyl dimethyl 2-[(2 methyl-1-oxo-2 propenyl) oxy]-salt.

Also included among the cationic monomers suitable for this invention are co-poly vinyl amine and co-polyvinylammonium salt; co-poly diallylamine, co-poly methyldiallylamine, and co-poly diallydimethylammonium salt; and the ionene class of internal cationic monomers. This class includes co-poly ethylene imine , co-poly ethoxylated ethylene imine and co-poly quaternized ethoxylated ethylene imine; co-poly [(dimethylimino) trimethylene (dimethylimino) hexamethylene disalt], co-poly [(diethylimino) trimethylene (dimethylimino) trimethylene disalt]; co-poly [(dimethylimino) 2-hydroxypropyl salt]; co-polyquarternium-2, co-polyquarternium-17, and co-polyquarternium 18, as defined in the "International Cosmetic Ingredient Dictionary" edited by Wenninger and McEwen.

Additionally, useful polymers are the cationic co-poly amido-amine having the chemical structure of formula II.

II

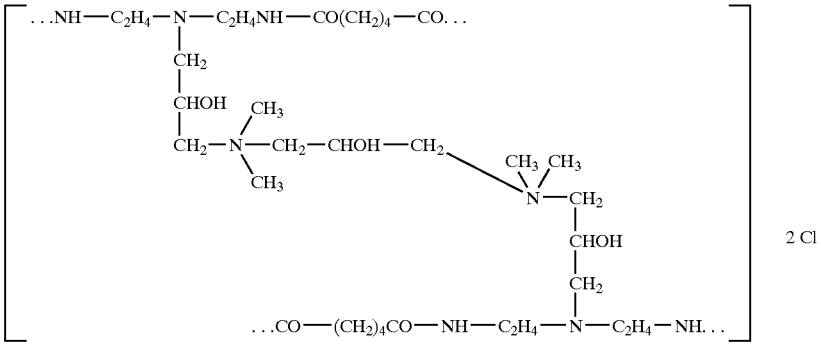

and the quaternized polyimidazoline having the chemical structure of formula III

III

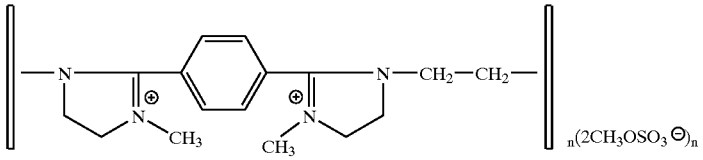

wherein the molecular weight of structures II and III can vary between about 10,000 and 10,000,000 Daltons and each is terminated with an appropriate terminating group such as, for example, a methyl group.

An additional, and highly preferred class of cationic monomers suitable for this invention are those arising from natural sources and include, but are not limited to, cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; guar 2-hydroxy-3-(trimethylammonium) propyl ether salt; cellulose 2-hydroxyethyl 2-hydroxy 3-(trimethyl ammonio) propyl ether salt.

It is likewise envisioned that monomers containing cationic sulfonium salts such as co-poly 1-[3-methyl-4-(vinylbenzyloxy)phenyl] tetrahydrothiophenium chloride would also be applicable to the present invention.

The counterion of the comprising cationic co-monomer is freely chosen from the halides: chloride, bromide, and iodide; or from hydroxide, phosphate, sulfate, hydrosulfate, ethyl sulfate, methyl sulfate, formate, and acetate.

Another class of cationic polymer useful for the present invention are the cationic silicones. These materials are characterized by repeating dialkylsiloxane interspersed or end terminated, or both, with cationic substituted siloxane units. Commercially available materials of this class are the Abil Quat polymers from Degussa Goldschmidt (Virginia).

The weight fraction of the cationic polymer which is composed of the above-described cationic monomer units can range from 1 to 100%, preferably from 10 to 100%, and most preferably from 15 to 80% of the entire polymer. The remaining monomer units comprising the cationic polymer are chosen from the class of anionic monomers and the class of nonionic monomers or solely from the class of nonionic monomers. In the former case, the polymer is an amphoteric polymer while in the latter case it can be a cationic polymer, provided that no amphoteric co-monomers are present. Amphoteric polymers should also be considered within the scope of this disclosure, provided that the polymer unit possesses a net positive charge at one or more points over the wash pH range of pH 6 to 11. The anionic monomers comprise a class of monounsaturated compounds which possess a negative charge over the portion of the pH range from pH 6 to 11 in which the cationic monomers possess a positive charge. The nonionic monomers comprise a class of monounsaturated compounds which are uncharged over the pH range from pH 6 to 11 in which the cationic monomers possess a positive charge. It is expected that the wash pH at which this invention would be employed would either naturally fall within the above mentioned portion of the pH range 6–11 or, optionally, would be buffered in that range. A preferred class of both the anionic and the nonionic monomers are the vinyl (ethylenically unsaturated) substituted compounds corresponding to formula IV.

IV

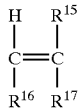

wherein $R^{15}$, $R^{16}$, and $R^{17}$ are independently hydrogen, a $C_1$ to $C_3$ alkyl, a carboxylate group or a carboxylate group substituted with a $C_1$ to $C_{30}$ linear or branched heteroatomic alkyl or aromatic radical, a heteroatomic radical or a poly oxyalkene condensate of an aliphatic radical.

The class of anionic monomers are represented by the compound described by formula IV in which at least one of the $R^{15}$, $R^{16}$, or $R^{17}$ comprises a carboxylate, substituted carboxylate, phosphonate, substituted phosphonate, sulfate, substituted sulfate, sulfonate, or substituted sulfonate group. Preferred monomers in this class include but are not limited to α-ethacrylic acid, α-cyano acrylic acid, β,β-dimethacrylic acid, methylenemalonic acid, vinylacetic acid, allylacetic acid, acrylic acid, ethylidineacetic acid, propylidineacetic acid, crotonic acid, methacrylic acid, maleic acid, fumaric acid, itaconic acid, sorbic acid, angelic acid, cinnamic acid, β-styryl acrylic acid (1-carboxy-4-phenyl butadiene-1,3), citraconic acid, glutaconic acid, aconitic acid, α-phenylacrylic acid, β-acryloxy propionic acid, citraconic acid, vinyl benzoic acid, N-vinyl succinamidic acid, and mesaconic acid. Also included in the list of preferred monomers are co-poly styrene sulfonic acid, 2-methacryloyloxymethane-1-sulfonic acid, 3-methacryloyloxypropane-1-sulfonic acid, 3-(vinyloxy) propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The polymers useful in this invention may contain the above monomers and the alkali metal, alkaline earth metal, and ammonium salts thereof.

The class of nonionic monomers are represented by the compounds of formula IV in which none of the $R^{15}$, $R^{16}$, or $R^{17}$ contain the above mentioned negative charge containing radicals. Preferred monomers in this class include, but are not limited to, vinyl alcohol; vinyl acetate; vinyl methyl ether; vinyl ethyl ether; acrylamide, methacrylamide and other modified acrylamides; vinyl propionate; alkyl acrylates (esters of acrylic or methacrylic acid); and hydroxyalkyl acrylate esters. A second class of nonionic monomers include co-poly ethylene oxide, co-poly propylene oxide, and co-poly oxymethylene. A third, and highly preferred, class of nonionic monomers includes naturally derived materials such as hydroxyethylcellulose and guar gum.

It is highly preferred, and often necessary in the case of certain compositions, to formulate the products of this invention with the proper ratio of cationic polymer to anionic surfactant. Relative to the surface area of the textiles generally laundered, the preferred ratios are unexpectedly low. If the ratio is too high, this can result in reduced softening, poor packing at the interface, unacceptable dissolution times and, in the case of liquid products, an excessively high viscosity which can render the product non-pourable, and thus unacceptable for consumer use. The use of lower ratios of cationic polymer to surfactant also reduces the overall level of polymer necessary for the formulation, which is also preferable for cost and environmental reasons, and gives the formulator greater flexibility in making a stable product. The preferred ratio of cationic polymer:total surfactant will be less than about 1:4, whereas the preferred ratio of cationic polymer:anionic surfactant will be less than about 1:5, and the preferred ratio of cationic polymer:nonionic surfactant will be less than about 1:5. More preferably, the ratios of cationic polymer:total surfactant, cationic polymer:anionic surfactant and cationic polymer: total surfactant will be less than about 1:10. In terms of absolute fraction, this often means that the concentration of cationic polymer will generally be less than about 5%, preferably less than about 2% and most preferably less than about 1% of the total product mass.

Without wishing to be bound by theory, it is believed that the species responsible for providing a conditioning benefit in these formulations is a polymer/surfactant complex. The compositions of this invention will preferably comprise at least about 2%, more preferably at least about 5%, and most preferably at least about 10% of one or more surfactants with a hydrophilic/lipophilic balance (HLB) of more than about 4. HLB is defined in U.S. Pat. No. 6,461,387, incorporated herein by reference.

Many of the aforementioned cationic polymers can be synthesized in, and are commercially available in, a number of different molecular weights. In order to achieve optimal cleaning and softening performance from the product, it is desirable that the water-soluble cationic or amphoteric polymer used in this invention be of an appropriate molecular weight. Without wishing to be bound by theory, it is believed that polymers that are too high in mass can entrap soils and prevent them from being removed. The use of cationic polymers with an average molecular weight of less than about 850,000 daltons, and especially those with an average molecular weight of less than 500,000 daltons can help to minimize this effect without significantly reducing the softening performance of properly formulated products. On the other hand, polymers with a molecular weight of about 10,000 daltons or less are believed to be too small to give an effective softening benefit.

In certain cases, especially when these polymers are to be used in a powdered detergent/softener or fabric softener formulation, lower molecular weight polymers can even improve the softening performance of the product. This is believed to be due to dissolution kinetics; materials of too high a molecular weight can fail to dissolve fully during the wash cycle, rendering them unavailable for softening fabrics. The preferred powdered compositions of this invention include materials that have a dissolution parameter of more than about 55.

Cleaning performance can further be improved by selecting a polymer with an appropriate level of cationic moiety. Again, it is believed that polymers with excessive levels of cationic charge can contribute to soil deposition, hindering the cleaning performance of either the fully formulated 2-in-1 detergent/softener or any laundry detergent that is used in conjunction with the compositions of this invention if they are to be standalone fabric softeners. Particularly appropriate materials are those that comprise less than about 2% by weight, preferably less than about 1.8% by weight of cationic nitrogen or phosphorus.

Optional Ingredients

In addition to the above-mentioned essential elements, the formulator may include one or more optional ingredients. While it is not necessary for these elements to be present in order to practice this invention, the use of such materials is often very helpful in rendering the formulation acceptable for consumer use.

Examples of optional components include, but are not limited to: nonionic surfactants, amphoteric and zwitterionic surfactants, cationic surfactants, hydrotropes, fluorescent whitening agents, photobleaches, fiber lubricants, reducing agents, enzymes, enzyme stabilizing agents, powder finishing agents, defoamers, builders, bleaches, bleach catalysts, soil release agents, antiredeposition agents, dye transfer inhibitors, buffers, colorants, fragrances, pro-fragrances, rheology modifiers, anti-ashing polymers, preservatives, insect repellents, soil repellents, water-resistance agents, suspending agents, aesthetic agents, structuring agents, sanitizers, solvents, fabric finishing agents, dye fixatives, wrinkle-reducing agents, fabric conditioning agents and deodorizers.

Preservatives

Optionally, a soluble preservative may be added to this invention. Contamination of the product by microorganisms, which can occur through both raw materials and consumer use, can have a number of undesirable effects. These include phase separation, the formation of bacterial and fungal colonies, the emission of objectionable odors and the like. The use of a preservative is especially preferred when the composition of this invention is a liquid, as these products tend to be especially susceptible to microbial growth.

The use of a broad-spectrum preservative, which controls the growth of bacteria and fungi is preferred. Limited-spectrum preservatives, which are only effective on a single group of microorganisms may also be used, either in combination with a broad-spectrum material or in a "package" of limited-spectrum preservatives with additive activities. Depending on the circumstances of manufacturing and consumer use, it may also be desirable to use more than one broad-spectrum preservative to minimize the effects of any potential contamination.

The use of both biocidal materials, i.e. substances that kill or destroy bacteria and fungi, and biostatic preservatives, i.e. substances that regulate or retard the growth of microorganisms, may be indicated for this invention.

In order to minimize environmental waste and allow for the maximum window of formulation stability, it is preferred that preservatives that are effective at low levels be used. Typically, they will be used only at an effective amount. For the purposes of this disclosure, the term "effective amount" means a level sufficient to control microbial growth in the product for a specified period of time, i.e., two weeks, such that the stability and physical properties of it are not negatively affected. For most preservatives, an effective amount will be between about 0.00001% and about 0.5% of the total formula, based on weight. Obviously, however, the effective level will vary based on the material used, and one skilled in the art should be able to select an appropriate preservative and use level.

Preferred preservatives for the compositions of this invention include organic sulfur compounds, halogenated materials, cyclic organic nitrogen compounds, low molecular weight aldehydes, quaternary ammonium materials, dehydroacetic acid, phenyl and phenoxy compounds and mixtures thereof.

Examples of preferred preservatives for use in the compositions of the present invention include: a mixture of about 77% 5-chloro-2-methyl-4-isothiazolin-3-one and about 23% 2-methyl-4-isothiazolin-3-one, which is sold commercially as a 1.5% aqueous solution by Rohm & Haas (Philadelphia, Pa.) under the trade name Kathon; 1,2-benzisothiazolin-3-one, which is sold commercially by Avecia (Wilmington, Del.) as, for example, a 20% solution in dipropylene glycol sold under the trade name Proxel GXL; and a 95:5 mixture of 1,3 bis (hydroxymethyl)-5,5-dimethyl-2,4 imidazolidinedione and 3-butyl-2-iodopropynyl carbamate, which can be obtained, for example, as Glydant Plus from Lonza (Fair Lawn, N.J.).

The preservatives described above are generally only used at an effective amount to give product stability. It is conceivable, however, that they could also be used at higher levels in the compositions on this invention to provide a biostatic or antibacterial effect on the treated articles.

Nonionic Surfactants

Nonionic surfactants are useful in the context of this invention to both improve the cleaning properties of the compositions, when used as a detergent, and to contribute to product stability. For the purposes of this disclosure, "nonionic surfactant" shall be defined as amphiphilic molecules with a molecular weight of less than about 10,000, unless otherwise noted, which are substantially free of any functional groups that exhibit a net charge at the normal wash pH of 6–11. Any type of nonionic surfactant may be used, although preferred materials are further discussed below.

Fatty Alcohol Ethoxylates $$R^{18}O(EO)_n$$

Wherein $R^{18}$ represents an alkyl chain of between 4 and 30 carbon atoms, (EO) represents one unit of ethylene oxide monomer and n has an average value between 0.5 and 20. R may be linear or branched. Such chemicals are generally produced by oligomerizing fatty alcohols with ethylene oxide in the presence of an effective amount catalyst, and are sold in the market as, for example, Neodols from Shell (Houston, Tex.) and Alfonics from Sasol (Austin, Tex.). The fatty alcohol starting materials, which are marketed under trademarks such as Alfol, Lial and Isofol from Sasol (Austin, Tex.) and Neodol, from Shell, may be manufactured by any of a number of processes known to those skilled in the art, and can be derived from natural or synthetic sources or a combination thereof. Commercial alcohol ethoxylates are typically mixtures, comprising varying chain lengths of $R^{18}$ and levels of ethoxylation. Often, especially at low levels of ethoxylation, a substantial amount of unethoxylated fatty alcohol remains in the final product, as well.

Because of their excellent cleaning, environmental and stability profiles, fatty alcohol ethoxylates wherein $R^{18}$ represents an alkyl chain from 10–18 carbons and n is an average number between 5 and 12 are highly preferred.

Alkylphenol Ethoxylates $$R^{19}ArO(EO)_n$$

Where $R^{19}$ represents a linear or branched alkyl chain ranging from 4 to 30 carbons, Ar is a phenyl ($C_6H_4$) ring and $(EO)_n$ is an oligomer chain comprised of an average of n moles of ethylene oxide. Preferably, $R^{19}$ is comprised of between 8 and 12 carbons, and n is between 4 and 12. Such materials are somewhat interchangeable with alcohol ethoxylates, and serve much the same function. A commercial example of an alkylphenol ethoxylate suitable for use in this invention is Triton X-100, available from Dow Chemical (Midland, Mich.)

Ethylene Oxide/Propylene Oxide Block Polymers $$(EO)_x(PO)_y(EO)_x$$

or $$(PO)_x(EO)_y(PO)_x$$

wherein EO represents an ethylene oxide unit, PO represents a propylene oxide unit, and x and y are numbers detailing the average number of moles ethylene oxide and propylene oxide in each mole of product. Such materials tend to have higher molecular weights than most nonionic surfactants, and as such can range between 1,000 and 30,000 daltons. BASF (Mount Olive, N.J.) manufactures a suitable set of derivatives and markets them under the Pluronic and Pluronic-R trademarks.

Other nonionic surfactants should also be considered within the scope of this invention. These include condensates of alkanolamines with fatty acids, such as cocamide DEA, polyol-fatty acid esters, such as the Span series available from Uniqema (Wlimington, Del.), ethoxylated polyol-fatty acid esters, such as the Tween series available from Uniqema (Wilmington, Del.), Alkylpolyglucosides, such as the APG line available from Cognis (Gulph Mills, Pa.) and n-alkylpyrrolidones, such as the Surfadone series of products marketed by ISP (Wayne, N.J.). Furthermore, nonionic surfactants not specifically mentioned above, but within the definition, may also be used.

Fluorescent Whitening Agents

Many fabrics, and cottons in particular, tend to lose their whiteness and adopt a yellowish tone after repeated washing. As such, it is customary and preferred to add a small amount of fluorescent whitening agent, which absorbs light in the ultraviolet region of the spectrum and re-emits it in the visible blue range, to the compositions of this invention, especially if they are combination detergent/fabric conditioner preparations.

Suitable fluorescent whitening agents include derivatives of diaminostilbenedisulfonic acid and their alkali metal salts. Particularly, the salts of 4,4'-bis(2-anilino4-morpholino-1,3,5-triazinyl-6-amino)stilbene-2,2'-disulfonic acid, and related compounds where the morpholino group is replaced by another nitrogen-comprising moiety, are preferred. Also preferred are brighteners of the 4,4'-bis(2-sulfostyryl) biphenyl type, which may optionally be blended with other fluorescent whitening agents at the option of the formulator. Typical fluorescent whitening agent levels in the preparations of this invention range between 0.001% and 1%, although a level between 0.1% and 0.3%, by mass, is normally used. Commercial supplies of acceptable fluorescent whitening agents can be sourced from, for example, Ciba Specialty Chemicals (High Point, N.C.) and Bayer (Pittsburgh, Pa.).

Builders

Builders are often added to fabric cleaning compositions to complex and remove alkaline earth metal ions, which can interfere with the cleaning performance of a detergent by combining with anionic surfactants and removing them from the wash liquor. The preferred compositions of this invention, especially when used as a combination detergent/softener, contain builders.

Soluble builders, such as alkali metal carbonates and alkali metal citrates, are particularly preferred, especially for the liquid embodiment of this invention. Other builders, as further detailed below, may also be used, however. Often a mixture of builders, chosen from those described below and others known to those skilled in the art, will be used.

Alkali and Alkaline Earth Metal Carbonates

Alkali and alkaline earth metal carbonates, such as those detailed in German patent application 2,321,001, published Nov. 15, 1973, are suitable for use as builders in the compositions of this invention. They may be supplied and used either in anhydrous form, or including bound water. Particularly useful is sodium carbonate, or soda ash, which both is readily available on the commercial market and has an excellent environmental profile.

The sodium carbonate used in this invention may either be natural or synthetic, and, depending on the needs of the formula, may be used in either dense or light form. Natural soda ash is generally mined as trona and further refined to a degree specified by the needs of the product it is used in. Synthetic ash, on the other hand, is usually produced via the Solvay process or as a coproduct of other manufacturing operations, such as the synthesis of caprolactam. It is sometimes further useful to include a small amount of calcium carbonate in the builder formulation, to seed crystal formation and increase building efficacy.

Organic Builders

Organic detergent builders can also be used as nonphosphate builders in the present invention. Examples of organic builders include alkali metal citrates, succinates, malonates, fatty acid sulfonates, fatty acid carboxylates, nitrilotriacetates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, acrylate/ maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062. Alkali metal citrates, nitrilotriacetates, oxydisuccinates, acrylate/maleate copolymers and acrylate/maleate/vinyl alcohol terpolymers are especially preferred nonphosphate builders.

Phosphates

The compositions of the present invention which utilize a water-soluble phosphate builder typically contain this builder at a level of from 1 to 90% by weight of the composition. Specific examples of water-soluble phosphate builders are the alkali metal tripolyphosphates, sodium, potassium and ammonium pyrophosphate, sodium and potassium orthophosphate, sodium polymeta/phosphate in which the degree of polymerization ranges from about 6 to 21, and salts of phytic acid. Sodium or potassium tripolyphosphate is most preferred.

Phosphates are, however, often difficult to formulate, especially into liquid products, and have been identified as potential agents that may contribute to the eutrophication of lakes and other waterways. As such, the preferred compositions of this invention comprise phosphates at a level of less than about 10% by weight, more preferably less than about 5% by weight. The most preferred compositions of this invention are formulated to be substantially free of phosphate builders.

Zeolites

Zeolites may also be used as builders in the present invention. A number of zeolites suitable for incorporation into the products of this disclosure are available to the formulator, including the common zeolite 4A. In addition, zeolites of the MAP variety, such as those taught in European Patent Application EP 384,070B, which are sold commercially by, for example, Ineos Silicas (UK), as Doucil A24, are also acceptable for incorporation. MAP is defined as an alkali metal aluminosilicate of zeolite P type having a silicon to aluminium ratio not exceeding 1.33, preferably within the range of from 0.90 to 1.33, more preferably within the range of from 0.90 to 1.20.

Especially preferred is zeolite MAP having a silicon to aluminium ratio not exceeding 1.07, more preferably about 1.00. The particle size of the zeolite is not critical. Zeolite A or zeolite MAP of any suitable particle size may be used. In any event, as zeolites are insoluble matter, it is advantageous to minimize their level in the compositions of this invention. As such, the preferred formulations contain less than about 10% of zeolite builder, while especially preferred compositions compress less than about 5% zeolite.

Enzyme Stabilizers

When enzymes, and especially proteases are used in liquid detergent formulations, it is often necessary to include a suitable quantity of enzyme stabilizer to temporarily deactivate it until it is used in the wash. Examples of suitable enzyme stabilizers are well-known to those skilled in the art, and include, for example, borates and polyols such as propylene glycol. Borates are especially suitable for use as enzyme stablizers because in addition to this benefit, they can further buffer the pH of the detergent product over a wide range, thus providing excellent flexibility.

If a borate-based enzyme stabilization system is chosen, along with one or more cationic polymers that are at least partially comprised of carbohydrate moeities, stability problems can result if suitable co-stablizers are not used. It is believed that this is the result of borates' natural affinity for hydroxyl groups, which can create an insoluble borate-polymer complex that precipitates from solution either over time or at cold temperatures. Incorporating into the formulation a co-stabilizer, which is normally a diol or polyol, sugar or other molecule with a large number of hydroxyl groups, can ordinarily prevent this. Especially preferred for use as a co-stabilizer is sorbitol, used at a level that is at least about 0.8 times the level of borate in the system, more preferably 1.0 times the level of borate in the system and most preferably more than 1.43 times the level of borate in the system, is sorbitol, which is effective, inexpensive, biodegradable and readily available on the market. Similar materials including sugars such as glucose and sucrose, and other poyols such as propylene glycol, glycerol, mannitol, maltitol and xylitol, should also be considered within the scope of this invention.

Fiber Lubricants

In order to enhance the conditioning, softening, wrinkle-reduction and protective effects of the compositions of this invention, it is often desirable to include one or more fiber lubricants in the formulation. Such ingredients are well known to those skilled in the art, and are intended to reduce the coefficient of friction between the fibers and yarns in articles being treated, both during and after the wash process. This effect can in turn improve the consumer's perception of softness, minimize the formation of wrinkles and prevent damage to textiles during the wash. For the purposes of this disclosure, "fiber lubricants" shall be considered non-cationic materials intended to lubricate fibers for the purpose of reducing the friction between fibers or yarns in an article comprising textiles which provide one or more wrinkle-reduction, fabric conditioning or protective benefit.

Examples of suitable fiber lubricants include oily sugar derivatives, functionalized plant and animal-derived oils, silicones, mineral oils, natural and synthetic waxes and the like. Such ingredients often have low HLB values, less than about 10, although exceeding this level is not outside of the scope of this invention.

Oily sugar derivatives suitable for use in this invention are taught in WO 98/16538, which is incorporated herein by reference. These are especially preferred as fiber lubricants, due to their ready availability and favorable environmental profile. When used in the compositions of this invention, such materials are typically present at a level between about 1% and about 10% of the finished composition. Another class of acceptable ingredients includes hydrophilically-modified plant and animal oils and synthetic triglycerides. Suitable and preferred hydrophilically modified plant, animal, and synthetic triglyceride oils and waxes have been identified as effective fiber lubricants. Such suitable plant derived triglyceride materials include hydrophilically modified triglyceride oils, e.g. sulfated, sulfonated, carboxylated, alkoxylated, esterified, saccharide modified, and amide derivatized oils, tall oils and derivatives thereof, and the like. Suitable animal derived triglyceride materials include hydrophilically modified fish oil, tallow, lard, and lanolin wax, and the like. An especially preferred functionalized oil is sulfated castor oil, which is sold commercially as, for example, Freedom SCO-75, available from Noveon (Cleveland, Ohio).

Various levels of derivatization may be used provided that the derivatization level is sufficient for the oil or wax derivatives to become soluble or dispersible in the solvent it is used in so as to exert a fiber lubrication effect during laundering of fabrics with a detergent containing the oil or wax derivative.

If this invention includes a functionalized oil of synthetic origin, preferably this oil is a silicone oil. More preferably, it is either a silicone poly ether or amino-functional silicone.

If this invention incorporates a silicone polyether, it is preferably of one of the two general structures shown below:

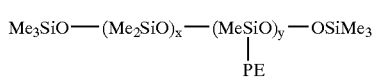

Structure A

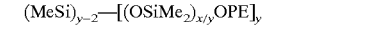

Structure B

Where PE represents:

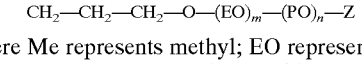

where Me represents methyl; EO represents ethylene oxide; PO represents 1,2 propylene oxide; Z represents either a hydrogen or a lower alkyl radical; x, y, m, n are constants and can be varied to alter the properties of the functionalized silicone.

A molecule of either structure can be used for the purposes of this invention. Preferably, this molecule contains more than 30% silicone, more than 20% ethylene oxide and less than 30% propylene oxide by weight, and has a molecular weight of more than 5,000. An example of a suitable, commercially available such material is L-7622, available from Crompton Corporation, (Greenwich, Conn.)

Amino-functional silicones come in a wide variety of structures, which are well-known to those skilled in the art. These are also useful in the context of this invention, although over time many of these materials can oxidize on fabrics, leading to yellowing. As this is not a desirable property of a fabric care composition, if an amino-functional silicone is used, preferably it is a hindered amine light stabilized product, which exhibits a greatly reduced tendency to show this behavior. A commercially available example of such a silicone is Hydrosoft, available from Rhodia—US (Cranbury, N.J.)

When the use of a fiber lubricant is elected, it will generally be present as between 0.1% and 15% of the total composition weight.

Bleach Catalyst

An effective amount of a bleach catalyst can also be present in the invention. A number of organic catalysts are available such as the sulfonimines as described in U.S. Pat. Nos. 5,041,232; 5,047,163 and 5,463,115.

Transition metal bleach catalysts are also useful, especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. Nos. 4,728,455, 5,114,606, 5,153,161, 5,194,416, 5,227,084, 5,244,594, 5,246,612, 5,246,621, 5,256,779, 5,274,147, 5,280,117 and European Pat. App. Pub. Nos. 544,440, 544,490, 549,271 and 549,272. Preferred examples of these catalysts include $Mn^{IV}{}_2(u\text{-}O)_2(1,4,7\text{-trimethyl-}1,4,7\text{-triazacyclononane})_2(PF_6)_2$, $Mn^{III}{}_2(u\text{-}O)_1(u\text{-}OAc)_2(1,4,7\text{-trimethyl-}1,4,7\text{-triazacyclononane})_2(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1(u\text{-}OAc)_2(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. Nos. 4,430,243 and 5,114,611. Other examples of complexes of transition metals include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2]\text{—}(ClO_4)_3$.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606, is a water soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

Other bleach catalysts are described, for example, in European Pat. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430.243 (Chelants with manganese cations and non-catalytic metal cations), and U.S. Pat. No. 4,728,455 (manganese gluconates).

Useful catalysts based on cobalt are described in WO 96/23859, WO 96/23860 and WO 96/23861 and U.S. Pat. No. 5,559,261. WO 96/23860 describe cobalt catalysts of the type $[CO_nL_mX_p]^zY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis(salicylidene)ethylenediaminecobalt (II). Other cobalt catalysts described in these applications are based on Co(III) complexes with ammonia and mono-, bi-, tri- and tetradentate ligands such as $[Co(NH_3)_5OAc]^{2+}$ with $Cl^-$, $OAc^-$, $PF_6^-$, $SO_4^=$, and $BF_4^-$ anions.

Certain transition-metal containing bleach catalysts can be prepared in the situ by the reaction of a transition-metal salt with a suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Hydrotropes

In many liquid and powdered detergent compositions, it is customary to add a hydrotrope to modify product viscosity and prevent phase separation in liquids, and ease dissolution in powders.

Two types of hydrotropes are typically used in detergent formulations and are applicable to this invention. The first of these are short-chain functionalized amphiphiles. Examples of short-chain amphiphiles include the alkali metal salts of xylenesulfonic acid, cumenesulfonic acid and octyl sulfonic acid, and the like. In addition, organic solvents and monohydric and polyhydric alcohols with a molecular weight of less than about 500, such as, for example, ethanol, isoporopanol, acetone, propylene glycol and glycerol, may also be used as hydrotropes.

Soil Release Agents

In order to prevent the resoiling of fabrics during and after the wash, one or more soil release agents may also be added to the products of this invention. Many different types of soil release agents are known to those skilled in the art, depending on the formulation in use and the desired benefit. The soil release agents useful in the context of this invention are typically either antiredeposition aids or stain-repelling finishes. Examples of anti-redeposition agents include soil release polymers, such as those described in WO 99/03963, which is incorporated herein by reference.

In addition, the cationic polymers of this invention are particularly advantageous when used in conjunction with a stain-repelling finish. Such materials are typically either fluoropolymers or fluorosurfactants, although the use of other amphiphilic materials with extremely hydrophobic lyophobes, such as silicone surfactants, is also conceivable. Nonlimiting examples of suitable anionic fluorosurfactants are taught in U.S. Pat. No. 6,040,053, which is incorporated herein by reference. Without wishing to be bound by theory, it is believed that the cationic polymers of this invention coordinate to the fabric surface and act as a substrate and deposition aid for the stain-repelling finish.

When an antiredeposition aid or stain-repelling finish is used, it is typically applied as 0.05% to 10% of the finished composition.

The following examples will more fully illustrate the embodiments of this invention. All parts, percentages and proportions referred to herein and in the appended claims are by weight unless otherwise illustrated. Physical test methods are described below.

TEST METHOD AND EXAMPLES

Fabric was washed with a variety of product, the formulations for which are set forth hereinbelow. The washed fabric was then tested by consumer panels for perceived softening. For each of the washes, product was added to a top loading Whirlpool washing machine that contained 17 gallons of water and 6 pounds of fabric. There were several 86% cotton/14% polyester hand towels in each machine along with 100% cotton sheets to bring the total weight of the fabric to 6 pounds. The temperature of the water for the washes was 32 deg. C. and the fabrics were washed for 12 minutes. After the rinse cycle, the fabrics were tumble dried. Two washes were done with each product. Each formula tested is benchmarked against two controls—one using a model detergent (dosed at 130 g for the liquid and 56 g for the powder at the beginning of the wash), and one using a model detergent plus a model liquid fabric softener. For the latter control, 100 g of the softening formula is added at the beginning of the rinse cycle. Liquid experimental formulations were tested against a model liquid detergent, whereas powdered experimental formulations were tested against a model powdered detergent The formulae for the model detergents are:

TABLE 1

Model Liquid Detergent

| Ingredient | Percent in Formula (based on 100% active) |
|---|---|
| Sodium linear alkylbenzenesulfonate | 10.2 |
| Alcohol ethoxylate | 9.5 |
| Sodium silicate | 3.3 |
| Hydrotrope | 0.5 |
| Sodium stearate | 0.4 |
| Fluorescent whitening agent | 0.1 |
| Water | to 100 |

TABLE 2

Model Powdered Detergent

| Ingredient | Percent in Formula (based on 100% active) |
|---|---|
| sodium linear alkylbenzenesulfonate | 13.0 |
| alcohol ethoxylate | 4.9 |
| sodium silicate | 0.5 |
| Zeolite (anhydrous basis) | 26.5 |
| Anti-ashing polymer | 1.5 |
| Sodium carbonate | 23.1 |
| Sodium sulfate | 19.4 |
| Protease enzyme | 0.4 |
| Fluorescent whitening agent | 0.3 |
| Water (bound in the formula) | To 100 |

The formula for the model liquid fabric softener is:

TABLE 3

Model Liquid Fabric Softener

| Ingredient | Percent in Formula (based on 100% active) |
|---|---|
| Dihydrogenated tallow dimethyl ammonium chloride | 3.5 |
| lactic acid | 0.015 |
| Calcium chloride | 0.015 |
| Water | to 100 |

Five panelists scored the softness of the hand towels on a 0–10 scale with 0 being "not soft at all" and 10 being "extremely soft". Duplicate panels were run based on the duplicate washes and the scores averaged over the two runs. A Softening Parameter (SP) was then calculated using the following formula:

$$SP=[(S_t-S_d)/(S_c-S_d)]\times 100$$

Where, $S_t$ is the softening score for the formula being tested $S_d$ is the softening score for model detergent, and $S_c$ is the softening score for the model detergent+model liquid fabric softener.

For experimental formulations 1–19, 29 and 30 in the following examples, the pH of the finished formula was checked and adjusted to between 9.2 and 9.6 with NaOH or HCl if needed. These liquids were used as combination detergent/softeners, and dosed at 130 grams per wash.

The dissolution kinetics of each polymer were measured by examining the turbidity of a stirred, 0.5% solution of polymer after 10 minutes of agitation, which closely corresponds to the length of an average US wash cycle. These experiments were undertaken using a 722 stirrer, 727 Ti-Stand, and 751 GPD Titrino (available from Metrohm, Westbury, N.Y.), a PC-800 Colorimeter (available from Brinkmann Instruments, Westbury, N.Y.) and a 250 ml disposable Falcon beaker. The calorimeter was first standardized with distilled water and a blocked path. 0.75 g of each polymer was added to 150 ml distilled water with the 722 stirrer on the "4" setting, and the system was allowed to agitate for 10 minutes, at which point the absorbance at 420 nm was measured. These data were then taken, and along with the standardization information, used to calculate a Dissolution Parameter (DP), wherein this corresponds to:

$$DP=\%\ T(420\text{ nm})\text{ at 10 minutes.}$$

Detergency experiments were carried out via a modification of ATSM Method D 3050-87 using a Terg-O-Tometer (available from SCS, Fairfield, N.J.) set to 100 RPM in 1000 ml of 90F water standardized to 120 ppm hardness with a Ca/Mg ratio of 2:1. Cloths were washed for 10 minutes with 2.21 g of detergent, followed by a 2 minute rinse and then tumble dried. Two types of standard soil cloth were used for each experiment: pigment/synthetic sebum on cotton (WFK-10d, available from WFK Testgewebe Gmbh, Bruggen-Bracht Germany) and pigment/oil on poly-cotton (PC-9, Available from C.F.T, Vlaardingen, Holland). Four cloths were used for each wash, and read prior to and after washing by a reflectometer (available from Hunterlab, Reston, Va.) using the D65 illuminant and 10° observer. Results are reported in terms of a Cleaning Parameter, $\Delta R_d$, which is calculated as:

$$\Delta R_d = R_F - R_I$$

where:

$R_F$=average reflectance of the monitor cloths after washing and $R_I$=average reflectance of the monitor cloths prior to washing.

Example 1

TABLE 4

Formulation 1

| Ingredient | Percent in Formula (based on 100% active) |
|---|---|
| Alcohol ethoxylate | 11.0 |
| linear alkyl benzene sulfonic acid | 4.2 |
| coconut fatty acid | 3.5 |
| oleic acid | 5.3 |
| propylene glycol | 9.0 |
| sodium hydroxide | 1.8 |
| Triethanolamine | 3.0 |
| sodium citrate | 5.0 |
| sodium borate | 3.0 |
| fluorescent whitening agent | 0.16 |
| Water | to 100 |

TABLE 5

Formulation 2

| Ingredient | Percent in Formula (based on 100% active) |
|---|---|
| alcohol ethoxylate | 12.0 |
| propylene glycol | 9.0 |
| Triethanolamine | 3.0 |
| sodium citrate | 5.0 |
| sodium borate | 3.0 |
| Polymer JR 30M[1] | 0.3 |
| fluorescent whitening agent | 0.16 |
| Water | to 100 |

[1]Available from the Amerchol division of Dow Chemical, Edison, N.J. Is an example of polyquaternium 10.

TABLE 6

Formulation 3

| Ingredient | Percent in Formula (based on 100% active) |
|---|---|
| alcohol ethoxylate | 11.0 |
| linear alkyl benzene sulfonic acid | 4.2 |
| coconut fatty acid | 3.5 |
| oleic acid | 5.3 |
| propylene glycol | 9.0 |
| sodium hydroxide | 1.8 |
| Triethanolamine | 3.0 |
| sodium citrate | 5.0 |
| sodium borate | 3.0 |
| Polymer JR 30M[1] | 0.3 |
| fluorescent whitening agent | 0.16 |
| Water | to 100 |

[1]Available from the Amerchol division of Dow Chemical, Edison N.J.

The following details the softening results for these three formulas:

TABLE 7

Softening Results for Formulations 1–3

| Formulation | Softening Parameter |
|---|---|
| 1 | 9 |
| 2 | 22 |
| 3 | 102 |

These results show that the combination of Polymer JR 30M and an anionic surfactant based laundry detergent give an excellent through the wash softening benefit. Both components are required for excellent, synergistic, softening—either component alone does not soften to nearly the extent of that of the mixture.

Example 2

The following general formulation was used to make experimental formulas 4–19 where a number of cationic polymers were tested and their softening parameters determined.

TABLE 8

| Ingredient | Percent in Formula (based on 100% active) |
|---|---|
| alcohol ethoxylate | 6.0 |
| Linear alkyl benzene sulfonic acid | 6.0 |
| coconut fatty acid | 3.0 |
| oleic acid | 5.0 |
| sodium hydroxide | 1.9 |
| monoethanolamine | 1.0 |
| sodium xylene sulfonate | 2.0 |
| sodium borate | 2.0 |
| cationic polymer (detailed in next table) | 0.3 |
| fluorescent whitening agent | 0.16 |
| Water | to 100 |

The following table lists softening parameters obtained with various cationic polymers.

TABLE 9

Softening Results for Formulations 4–19

| Formulation | Cationic Polymer Commercial Name | Chemical Structure | Softening Parameter |
|---|---|---|---|
| 4 | Merquat 5[1] | methacryloyloxethyl trimethyammonium methyl sulfate/acrylamide copolymer | 0 |
| 5 | Mirapol A-15[2] | polyquat ammonium chloride | 0 |
| 6 | Merquat 2001[1] | methacryl amidopropyl trimethyl ammonium chloride/acrylic acid/acrylamide terpolymer | 33 |
| 7 | Gafquat 734[3] | vinylpyrrolidone/dimethyl aminoethyl methacrylate copolymer | 35 |
| 8 | Merquat S[1] | dimethyl diallyl ammonium chloride/acrylamide copolymer | 41 |
| 9 | Merquat 3330[1] | dimethyl diallyl ammonium chloride/acrylic acid/acrylamide terpolymer | 43 |
| 10 | Luviquat FC 550[4] | vinylpyrrolidone/methyl vinyl imidazolium chloride copolymer | 44 |
| 11 | Merquat 100[1] | polydimethyl diallyl ammonium chloride | 53 |
| 12 | Censomer Cl 50[1] | starch hydroxypropyl trimmonium chloride | 69 |
| 13 | Polycare 133[2] | polymethacryl amidopropyl trimethyl ammonium chloride | 83 |
| 14 | Salcare SC60[5] | acrylamidopropyl trimmonium chloride/acrylamide copolymer | 95 |
| 15 | Jaguar Excell[2] | guar hydroxypropyl trimonium chloride | 116 |
| 16 | Jaguar C-14S[2] | guar hydroxypropyl trimonium chloride | 116 |
| 17 | Jaguar C-17[2] | guar hydroxypropyl trimonium chloride | 120 |
| 18 | Jaguar C-162[2] | guar hydroxypropyl trimonium chloride | 124 |
| 19 | Polymer JR 30M[6] | hydroxyethyl cellulose derivatized with trimethyl ammonium substituted epoxide | 160 |

[1]Available from Ondeo-Nalco, Naperville, III.
[2]Available from Rhodia-US, Cranbury N.J . . .
[3]Available from ISP, Wayne N.J.
[4]Available from BASF, Mount Olive N.J . . .
[5]Available from Ciba, High Point N.C.
[6]Available from the Amerchol division of Dow Chemical, Edison N.J . . .
Note:
for formulations 15–18, the polymer was added directly to the washing machine separately from the rest of the detergent ingredients listed in the above general formulation.

The softening results show that many of the cationic polymers tested yielded superior softening through the wash when used in combination with anionic surfactants. Specifically, the cationic polymers used in experimental formulations 8–19 were deemed to be superior.

Example 3

The following formulations detail various laundry formulations that can be practiced within the scope of this invention:

TABLE 10

Formulation 20 - Liquid Laundry Detergent A

| Ingredient | Percent in Formula (based on 100% active) |
|---|---|
| alcohol ethoxylate | 4–25 |
| total anionic surfactant[1] | 5–50 |
| propylene glycol | 0–10 |
| sodium hydroxide | 0.1–5 |
| Triethanolamine | 0–5 |
| sodium citrate | 0–10 |
| sodium borate | 0–10 |
| Polymer JR 30M | 0.1–5 |
| fluorescent whitening agent | 0–1 |
| Antiredeposition polymer | 0–2 |
| protease enzyme | 0–1 |
| lipase enzyme | 0–1 |
| cellulase enzyme | 0–1 |
| Perfume | 0–2 |
| Preservative | 0–1 |
| soil release polymer | 0–2 |
| Water | to 100 |

[1]e.g. linear alkyl benzene sulfonic acid; neutralized fatty acids (including oleic; coconut; stearic); secondary alkane sulfonate; alcohol ethoxy sulfate

TABLE 11

Formulation 21 - Liquid Laundry Detergent B

| Ingredient | Percent in Formula (based on 100% active) |
|---|---|
| ethoxylated nonionics | 4.0–25.0 |
| total anionic surfactant[1] | 5–50 |
| sodium hydroxide | 0–10.0 |
| Polymer JR 30M | 0.1–5.0 |
| sodium xylene sulfonate | 0–8.0 |
| sodium silicate | 1.0–12.0 |
| fluorescent whitening agent | 0–0.4 |
| fragrance | 0–1.0 |
| Water | to 100 |

[1]e.g. linear alkyl benzene sulfonic acid; neutralized fatty acids (including oleic; coconut; stearic); secondary alkane sulfonate; alcohol ethoxy sulfate Typically one wash with a detergent prepared with and without the inventive cationic polymer/anionic surfactant mixture is performed using approximately 90–150 g of liquid detergent in 17 gallons of water at 35 deg. Celsius.

TABLE 12

Formulation 22 - Liquid Fabric Conditioner

| Ingredient | Percent in Formula (based on 100% active) |
|---|---|
| total anionic surfactant[1] | 5.0–50.0 |
| Polymer JR 30M | 0.1–5.0 |
| sodium xylene sulfonate | 0–8.0 |
| Triethanolamine | 0–5 |
| fluorescent whitening agent | 0–0.4 |
| fragrance | 0–1.0 |
| Water | to 100 |

[1]e.g. linear alkyl benzene sulfonic acid; neutralized fatty acids (including oleic; coconut; stearic); secondary alkane sulfonate; alcohol ethoxy sulfate Typically one wash (either added at the beginning of the wash or beginning of the rinse cycle) with a softener prepared with and without the inventive cationic polymer/ anionic surfactant mixture is performed using approximately 25–150 g of liquid softener in 17 gallons of water at 35 deg. Celsius.

TABLE 13

Formulation 23 - Laundry Detergent Powder

| Ingredient | Percent in Formula (based on 100% active) |
|---|---|
| ethoxylated nonionics | 2.0–20.0 |
| total anionic surfactant[1] | 4.0–20.0 |
| sodium hydroxide | 1.0–8.0 |
| sodium aluminosilicate | 0–25.0 |
| sodium carbonate | 0–30.0 |
| sodium sulfate | 0–30.0 |
| sodium silicate | 0.1–3.0 |
| antiredeposition agent | 0–3.0 |
| sodium perborate | 0–8.0 |
| protease enzyme | 0–2.0 |
| Fragrance | 0–1.5 |
| fluorescent whitening agent | 0–2.0 |
| Polymer JR 30M | 0.1–10.0 |
| Water | to 100 |

[1]e.g. linear alkyl benzene sulfonic acid; neutralized fatty acids (including oleic; coconut; stearic); secondary alkane sulfonate; alcohol ethoxy sulfate Typically one wash with a detergent prepared with and without the inventive cationic polymer/anionic surfactant mixture is performed using approximately 50–90 g of powdered detergent in 17 gallons of water at 35 deg. Celsius.

TABLE 14

Formulation 24 - Laundry Detergent Tablet

| Ingredient | Percent in Formula (based on 100% active) |
|---|---|
| ethoxylated nonionics | 2.0–15.0 |
| total anionic surfactant[1] | 3.0–20.0 |
| sodium Hydroxide | 1.0–8.0 |
| sodium aluminosilicate | 5.0–25.0 |
| sodium carbonate | 5.0–40.0 |
| sodium sulfate | 1.0–10.0 |
| sodium acetate trihydrate | 10.0–40.0 |
| fluorescent whitener | 0–2.0 |
| Fragrance | 0–2.0 |
| protease enzyme | 0–2.0 |
| antiredeposition agent | 0–2.0 |
| Polymer JR 30M | 0.1–10.0 |
| Water | to 100 |

[1]e.g. linear alkyl benzene sulfonic acid; neutralized fatty acids (including oleic; coconut; stearic); secondary alkane sulfonate; alcohol ethoxy sulfate Typically one wash with a detergent prepared with and without the inventive cationic polymer/anionic surfactant mixture is performed using 2 detergent tablets weighing approximately 40 g each in 17 gallons of water at 35 deg. Celsius.

TABLE 15

Formulation 25 - Fabric Conditioning Powder

| Ingredient | Percent in Formula (based on 100% active) |
|---|---|
| total anionic surfactant[1] | 20.0–90.0 |
| Polymer JR 30M | 0.1–15 |
| sodium carbonate | 0–40.0 |
| sodium sulfate | 0–10.0 |
| sodium bicarbonate | 0–40.0 |
| sodium chloride | 0–40.0 |

TABLE 15-continued

Formulation 25 - Fabric Conditioning Powder

| Ingredient | Percent in Formula (based on 100% active) |
|---|---|
| Perfume | 0–2.0 |
| Water | To 100 |

[1]e.g. linear alkyl benzene sulfonic acid; neutralized fatty acids (including oleic; coconut; stearic); secondary alkane sulfonate; alcohol ethoxy sulfate Typically one wash with a conditioner prepared with and without the inventive cationic polymer/anionic surfactant mixture is performed using approximately 40–150 g of powdered fabric conditioner in 17 gallons of water at 35 deg. Celsius.

TABLE 16

Formulation 26 - Water Soluble Sheet

| Ingredient | Percent in Formula (based on 100% active) |
|---|---|
| water soluble sheet material | 1.0–30.0 |
| total anionic surfactant[1] | 20.0–95.0 |
| Polymer JR 30M | 0.1–15 |
| Perfume | 0–5.0 |

[1]e.g. linear alkyl benzene sulfonic acid; neutralized fatty acids (including oleic; coconut; stearic); secondary alkane sulfonate; alcohol ethoxy sulfate Typically one wash with a softener prepared with and without the inventive cationic polymer/anionic surfactant mixture is performed using 1 or 2 approximately 15–35 g sheets in 17 gallons of water at 35 deg. Celsius.

TABLE 17

Formulation 27 - Water Soluble Sachet

| Ingredient | Percent in Formula (based on 100% active) |
|---|---|
| water soluble sheet material | 0.3–10.0 |
| total anionic surfactant[1] | 10.0–70.0 |
| Polymer JR 30M | 0.1–15 |
| non-aqueous liquid carrier[2] | 15.0–75.0 |
| Water | 2.0–10.0 |
| Perfume | 0–5.0 |

[1]e.g. linear alkyl benzene sulfonic acid; neutralized fatty acids (including oleic; coconut; stearic); secondary alkane sulfonate; alcohol ethoxy sulfate
[2]e.g. propylene glycol; glycerol; glycol ether; alcohol ethoxylate Typically one wash with a softener prepared with and without the inventive cationic polymer/anionic surfactant mixture is performed using 1 or 2 approximately 20–50 g sachets in 17 gallons of water at 35 deg. Celsius.

TABLE 18

Formulation 28 - Stain Repellency Liquid[1]

| Ingredient | Percent in Formula (based on 100% active) |
|---|---|
| Polymer LR-400[2] | 0.1–15.0 |
| total anionic fluorocarbon surfactant[3] | 2.0–20.0 |

TABLE 18-continued

| Formulation 28 - Stain Repellency Liquid[1] | |
|---|---|
| Ingredient | Percent in Formula (based on 100% active) |
| sodium hydroxide | 0.05–2.0 |
| Perfume | 0–5.0 |

[1]Final pH adjusted to between 9 and 10 with NaOH
[2]Available from Amerchol/Dow, Midland, Michigan, USA.
[3]e.g. Zonyl FSA, Zonyl FSP, and Zonyl TBS all available from DuPont, Wilmington, Delaware Typically one wash with prepared with and without the inventive cationic polymer/anionic fluorocarbon surfactant mixture added at the beginning of the rinse cycle is performed using approximately 50–200 g of stain repellency liquid in 17 gallons of water.

The above-identified inventive cationic polymer/anionic surfactant mixtures may be incorporated in liquid, powdered/granular, semi-solid or paste, molded solid or tablet, and water soluble sheet compositions.

Example 4

This comparative example demonstrates that the inventive compositions of the present invention are superior to commercially available softening detergents with respect to delivering softening through the wash benefits. Bold™ powder, Yes™ liquid and Solo™ liquid were purchased at a retail store and used according to the instructions on the package for a "normal" load size. Washes were carried out as described in Example 1 above and the softening parameters measured.

They were determined to be:*

TABLE 19

| Commercial Softening Detergent | Softening Parameter |
|---|---|
| Bold ™ powder | 0 |
| Yes ™ liquid | 6 |
| Solo ™ liquid | 0 |

Example 5

This example demonstrates that although U.S. Pat. Appl. Nos. 2002/0155981 and 2002/0151454 teach softening detergent technology, the level of softening delivered is inferior to the level taught in this invention. The following comparative formula was reproduced from Example 2 in Table 1 of U.S. 2002/0155981 A1.

TABLE 20

| Comparative Formulation 1 | |
|---|---|
| Ingredient | Percent in Formula (as is) |
| linear alkyl benzene sulfonate (95.5% active in water) | 5 |
| coconut fatty acid | 2 |
| alcohol ethoxylate - average of 12 carbon, 7 mole ethoxylate | 3 |
| zeolite 4A | 25 |
| Jaguar C-17[1] | 5 |
| Sokolan CP-5[2] | 5 |

TABLE 20-continued

| Comparative Formulation 1 | |
|---|---|
| Ingredient | Percent in Formula (as is) |
| Gelwhite GP[3] | 5 |
| PVP (powder) | 0.5 |
| NaOH (50% in water) | 3 |
| light soda ash | 15 |
| sodium silicate | 3 |
| sodium sulfate | 28.5 |

[1]Available from Rhodia - US, Carnbury N.J.
[2]Available from BASF, Mount Olive N.J.;
[3]Available from Southern Clay Products, Gonzales Tex.

The Softening parameter of the Comparative Formulation 1 was determined to be 35.

Example 6

This example shows that the use of polymer JR in an anionic surfactant-containing liquid detergent in combination with a polysaccharide polymer such as xanthan gum leads to an unacceptable product.

The following formulation was made and found to be unstable as a large quantity of white precipitate formed upon addition of xanthan gum (polymer JR had already been added).

TABLE 21

| Comparative Formulation 2 | |
|---|---|
| Ingredient | Percent in Formula (based on 100% active) |
| alcohol ethoxylate | 6.0 |
| linear alkyl benzene sulfonic acid | 6.0 |
| coconut fatty acid | 3.0 |
| oleic acid | 5.0 |
| sodium xylene sulfonate | 2.0 |
| sodium hydroxide | 1.8 |
| Monoethanolamine | 1.0 |
| sodium citrate | 5.0 |
| sodium borate | 2.0 |
| Polymer JR 30M[1] | 0.3 |
| xanthan gum | 0.5 |
| fluorescent whitening agent | 0.16 |
| water[2] | to 100 |

[1]Available from the Amerchol division of Dow Chemical, Edison N.J.
[2]After water addition, pH checked and adjusted to between 9.2 and 9.6 with NaOH or HCl if needed.

Because the polymer JR was precipitated out of solution in the presence of polysaccharide, no softening was afforded by this formula.

Example 7

The following comparative example demonstrates the importance of the inventive cationic polymer: surfactant, cationic polymer: anionic surfactant and cationic polymer: nonionic surfactant ratios in obtaining a flowable, acceptable consumer liquid laundry detergent. Comparative formulation 3 employs ratios taught in U.S. Patent Appl. Nos. 2002/0151454, 2002/0155981, 2002/0055451 and 2002/0058604.

TABLE 22

| Comparative Formulation 3 | |
|---|---|
| Ingredient | Percent in Formula (based on 100% active) |
| Phase A | |
| alcohol ethoxylate | 6 |
| fluorescent whitening agent | 0.158 |
| sodium xylene sulfonate | 2 |
| Main Mix | |
| Water | 55 |
| sodium tetraborate pentahydrate | 2 |
| Polymer JR 30M[1] | 4 |
| sodium hydroxide | 1.91 |
| Monoethanolamine | 1 |
| alkylbenzenesulfonic acid | 6 |
| coconut oil fatty acid | 3 |
| oleic acid | 5 |
| Phase A | Added |
| Water | to 100 |

[1]Available from Amerchol division of Dow Chemical, Edison N.J.

The cationic polymer:surfactant ratio of comparative formulation 3 is 1:5; the cationic polymer:anionic surfactant ratio is 2:7 the cationic polymer:nonionic surfactant ratio is 1:3.

TABLE 23

| Formulation 29 | |
|---|---|
| Ingredient | Percent in Formula (based on 100% active) |
| Phase A | |
| alcohol ethoxylate | 6 |
| fluorescent whitening agent | 0.158 |
| sodium xylene sulfonate (40%) | 2 |
| Main Mix | |
| water | 55 |
| sodium tetraborate pentahydrate | 2 |
| Polymer JR 30M[1] | 0.3 |
| sodium hydroxide (50%) | 1.91 |
| monoethanolamine | 1 |
| alkylbenzenesulfonic acid | 6 |
| coconut oil fatty acid | 3 |
| oleic acid | 5 |
| Phase A | Added |
| water | to 100 |

[1]Available from Amerchol division of Dow Chemical, Edison N.J.

The cationic polymer:surfactant ratio of formulation 29 is 1:66.7; the cationic polymer:anionic surfactant ratio is 1:46.7; the cationic polymer:nonionic surfactant ratio is 1:20.

In both formulations, all ingredients were added in the order specified in the table. Phase A in each was made and kept at 140F until it was added at the point designated in the formula. Between additions, 5 minutes of constant mixing using an IKA RW 20 DZM.n mechanical stirrer equipped with a double-blade impeller took place to allow uniform blending to take place.

After batching, the viscosity of each formula was measured with a Brookfield LV Viscometer (available from Brookfield Engineering, Stoughton, Mass.). The viscosity of comparative formulation 3 could not be measured, as the product was sufficiently thick to be out of the range (1,000, 000 cP) of the viscometer. The viscosity of formulation 28 was measured as 430 cP with a #1 spindle at 12 rpm, which is well within the accepted range for consumer liquid laundry detergents (50–1000 cP).

Example 8

The following example demonstrates that liquid laundry detergent formulations comprising zeolites, layered silicates and phosphates, along with cationic polymers tend to be unstable and aesthetically unacceptable for commercial sale. U.S. Pat. Appl. Nos. 2002/0151454, 2002/0155981, 2002/0055451 and 2002/0058604 teach the use of one or more of zeolite, layered silicate and phosphate.

TABLE 24

| Formulation 30 - No zeolite, phosphate or layered silicate | |
|---|---|
| Ingredient | Percent in Formula (based on 100% active) |
| PHASE A | |
| Alcohol ethoxylate | 6 |
| Fluorescent whitening agent | 0.158 |
| Sodium xylene sulfonate (40%) | 2 |
| MAIN MIX | |
| Water | 55 |
| Sodium tetraborate pentahydrate | 2 |
| Polymer JR 30M[1] | 0.3 |
| Sodium hydroxide (50%) | 1.91 |
| Triethanolamine | 3 |
| Alkylbenzenesulfonic acid | 6 |
| Coconut oil fatty acid | 3 |
| oleic acid | 5 |
| Phase A | Added |
| Water | to 100 |

[1]Available from Amerchol division of Dow Chemical, Edison N.J.

TABLE 25

| Comparative Formulation 4 - Comprises zeolite | |
|---|---|
| Ingredient | Percent in Formula (based on 100% active) |
| PHASE A | |
| Alcohol ethoxylate | 6 |
| Fluorescent whitening agent | 0.158 |
| Sodium xylene sulfonate (40%) | 2 |
| MAIN MIX | |
| Water | 55 |
| sodium tetraborate pentahydrate | 2 |
| Polymer JR 30M[2] | 0.3 |
| sodium hydroxide (50%) | 1.91 |
| Triethanolamine | 3 |
| Alkylbenzenesulfonic acid | 6 |
| coconut oil fatty acid | 3 |
| oleic acid | 5 |
| zeolite 4A[1] | 3 |
| Phase A | Added |
| Water | to 100 |

[1]Available from INESO Silicas, Joliet, IL.
[2]Available from Amerchol division of Dow Chemical, Edison N.J.

TABLE 26

| Comparative Formulation 5 - Comprises phosphate | |
|---|---|
| Ingredient | Percent in Formula (based on 100% active) |
| PHASE A | |
| alcohol ethoxylate | 6 |
| Fluorescent whitening agent | 0.158 |
| sodium xylene sulfonate (40%) | 2 |
| MAIN MIX | |
| Water | 55 |
| sodium tetraborate pentahydrate | 2 |
| Polymer JR 30M[1] | 0.3 |
| sodium hydroxide (50%) | 1.91 |
| Triethanolamine | 3 |
| Alkylbenzenesulfonic acid | 6 |
| coconut oil fatty acid | 3 |
| oleic acid | 5 |
| sodium Phosphate | 10 |
| Phase A | Added |
| Water | to 100 |

[1]Available from Amerchol division of Dow Chemical, Edison N.J.

TABLE 27

| Comparative Formulation 6 - comprises layered silicate | |
|---|---|
| Ingredient | Percent in Formula (based on 100% active) |
| PHASE A | |
| alcohol ethoxylate | 6 |
| Fluorescent whitening agent | 0.158 |
| sodium xylene sulfonate (40%) | 2 |
| MAIN MIX | |
| Water | 55 |
| sodium tetraborate pentahydrate | 2 |
| Polymer JR 30M[2] | 0.3 |
| sodium hydroxide (50%) | 1.91 |
| Triethanolamine | 3 |
| Alkylbenzenesulfonic acid | 6 |
| Coconut oil fatty acid | 3 |
| oleic acid | 5 |
| Gelwhite GP[1] | 5 |
| Phase A | Added |
| Water | to 100 |

[1]A bentonite-type layered silicate; available from Southern Clay Products, Gonzales, Tex.;
[2]Available from Amerchol division of Dow Chemical, Edison N.J.

All ingredients were added in the order specified in the tables. Phase A in each was made and kept at 140F until it was added at the point designated in the formula. Between additions, 5 minutes of constant mixing using an IKA RW 20 DZM.n mechanical stirrer equipped with a double-blade impeller took place to allow uniform blending to take place.

After batching, all these formulations were permitted to stand at 70F for one week to assess their physical stability. Formulation 30 remained a clear, isotropic liquid after this period. In the case of comparative formulation 4, the zeolite settled to the bottom of the storage container. Comparative formulation 5 phase-separated, suggesting, without wishing to be bound by theory, that the sodium phosphate had salted out the surfactants and/or polymer. Likewise, comparative formulation 6 was also physically unstable, separating into 3 distinct layers.

Example 9

The following example illustrates how the cleaning performance of fabric softening compositions comprising cationic polymers can be improved without negatively impacting their conditioning properties by selecting a polymer of appropriate molecular weight and charge density.

TABLE 28

| Formulation 30: Comprises high molecular-weight, highly substituted cationic polymer. | |
|---|---|
| Ingredient | Percent in Formula (based on 100% active) |
| Phase A | |
| Alcohol ethoxylate | 6 |
| Fluorescent whitening agent | 0.158 |
| Sodium xylene sulfonate (40%) | 2.0 |
| Main Mix | |
| Water | 55 |
| Sodium tetraborate pentahydrate | 1.5 |
| Sorbitol | 3.0 |
| Polymer JR 30M[1] | 0.3 |
| Sodium hydroxide (50%) | 1.91 |
| Triethanolamine | 1.0 |
| Alkylbenzenesulfonic acid | 6.0 |
| Coconut oil fatty acid | 8 |
| Phase A | Added |
| Water | to 100 |

[1]Available from the Amerchol division of Dow Chemical, Edison N.J.

TABLE 29

| Formulation 31: Comprises lower molecular-weight, highly substituted cationic polymer. | |
|---|---|
| Ingredient | Percent in Formula (based on 100% active) |
| Phase A | |
| Alcohol ethoxylate | 6 |
| Fluorescent whitening agent | 0.158 |
| Sodium xylene sulfonate (40%) | 2.0 |
| Main Mix | |
| Water | 55 |
| Sodium tetraborate pentahydrate | 1.5 |
| Sorbitol | 3.0 |
| Polymer JR 400[1] | 0.3 |
| Sodium hydroxide (50%) | 1.91 |
| Triethanolamine | 1.0 |
| Alkylbenzenesulfonic acid | 6.0 |
| Coconut oil fatty acid | 8 |
| Phase A | Added |
| Water | to 100 |

[1]Available from the Amerchol division of Dow Chemical, Edison N.J. Is an example of polyquaternium 10.

TABLE 30

| Formulation 32: Comprises lower molecular-weight, less substituted cationic polymer. | |
|---|---|
| Ingredient | Percent in Formula (based on 100% active) |
| Phase A | |
| Alcohol ethoxylate | 6 |
| Fluorescent whitening agent | 0.158 |
| Sodium xylene sulfonate (40%) | 2.0 |

TABLE 30-continued

| Formulation 32: Comprises lower molecular-weight, less substituted cationic polymer. | |
|---|---|
| Ingredient | Percent in Formula (based on 100% active) |
| Main Mix | |
| Water | 55 |
| Sodium tetraborate pentahydrate | 1.5 |
| Sorbitol | 3.0 |
| Polymer LR 400[1] | 0.3 |
| Sodium hydroxide (50%) | 1.91 |
| Triethanolamine | 1.0 |
| Alkylbenzenesulfonic acid | 6.0 |
| Coconut oil fatty acid | 8 |
| Phase A | Added |
| Water | to 100 |

[1]Available from the Amerchol division of Dow Chemical, Edison N.J.

All ingredients were added in the order specified in the tables. Phase A in each was made and kept at 140F until it was added at the point designated in the formula. Between additions, 5 minutes of constant mixing using an IKA RW 20 DZM.n mechanical stirrer equipped with a double-blade impeller took place to allow uniform blending to take place. Polymer JR 30M has a molecular weight of approximately 900,000 daltons and a nitrogen content of approximately 2%, whereas Polymer JR 400 has an average molecular weight of approximately 400,000 daltons and a nitrogen content of approximately 2%. Polymer LR 400 has an average molecular weight of approximately 400,000 daltons and a nitrogen content of approximately 1%. After batching, the cleaning efficacy of each product evaluated. The following table details the cleaning performance of each formula:

TABLE 31

| Cleaning Performance of Prototype Formulations | | |
|---|---|---|
| Formulation | Soil Cloth | Cleaning Parameter, $\Delta R_d$ |
| 30 | WFK-10D | 2.8925 |
| 30 | PC-9 | 9.1125 |
| 31 | WFK-10D | 7.6125 |
| 31 | PC-9 | 13.2325 |
| 32 | WFK-10D | 10.2800 |
| 32 | PC-9 | 14.0525 |

The softening performance of each formulation as a detergent/softener combination product was also evaluated. The results of this are:

TABLE 32

| Softening Results of Prototype Formulations | |
|---|---|
| Formulation | Softening Parameter |
| 30 | 134 |
| 31 | 123 |
| 32 | 191 |

These data show that using a cationic polymer of a lower molecular weight than Polymer JR 30M, and with a lower degree of cationic substitution than Polymer JR 30M can improve cleaning performance without negatively impacting softening.

Example 10

The following example demonstrates how the selection of a lower molecular-weight polymer can also improve softening performance in applications such as powdered detergent compositions.

TABLE 33

| Formulation 33: Powdered Detergent comprising high molecular-weight cationic polymer | |
|---|---|
| Ingredient | Percent in Formula (based on 100% active) |
| Base Powder | |
| Sodium Carbonate | 32.94 |
| Sodium Sulfate | 18.83 |
| Alkylbenzenesulfonic Acid | 9.63 |
| Sodium Silicate | 16.47 |
| Fluorescent Whitening Agent | 0.1 |
| Water | 4.40 |
| Post-Dose | |
| Polymer JR 30M[1] | 0.62 |
| Sodium Cocoate | 17.01 |

[1]Available from the Amerchol division of Dow Chemical, Edison N.J.

TABLE 34

| Formulation 34: Powdered Detergent comprising low molecular-weight cationic polymer | |
|---|---|
| Ingredient | Percent in Formula (based on 100% active) |
| Base Powder | |
| Sodium Carbonate | 32.94 |
| Sodium Sulfate | 18.83 |
| Alkylbenzenesulfonic Acid | 9.63 |
| Sodium Silicate | 16.47 |
| Fluorescent Whitening Agent | 0.1 |
| Water | 4.40 |
| Post-Dose | |
| Polymer LR 400[1] | 0.62 |
| Sodium Cocoate | 17.01 |

[1]Available from the Amerchol division of Dow Chemical, Edison N.J.

In both formulas, the ingredients, with the exception of the polymer and sodium cocoate were first combined and spray-dried into a base powder. Following this, the sodium cocoate and polymer were post-dosed, and all components were agitated for 60 seconds in a Waring Laboratory Blender on the low speed. For each formulation, the powder was dosed at 66.79 g/wash.

After batching, a softness parameter was generated for each formula using the methodology described earlier in this specification. The results of this experiment are detailed in Table 34:

TABLE 35

| Softening Results of Prototype Powder Formulations | |
|---|---|
| Formulation | Softening Parameter |
| 33 | 19 |
| 34 | 91 |

The molecular weight of many polymers directly corresponds to their rate of dissolution, and it is believed that the higher rate of dissolution of Polymer LR 400, which allows more material to be available for softening during the wash cycle, is responsible for this. In order to confirm the nature of this benefit in powders, dissolution parameters were measured for each material and are shown below in Table 35:

TABLE 36

Dissolution Parameters of Cationic Polymers

| Material | Dissolution Parameter |
|---|---|
| Polymer JR 30M | 53.6 |
| Polymer LR 400 | 82.9 |

These data show that in certain cases, such as detergent powders where the polymer is not pre-dissolved, that the use of a lower molecular weight polymer, which has more rapid dissolution kinetics can act to improve softening.

Example 11

The following example illustrates how the odor profile of fabric softening compositions comprising cationic polymers can be improved without negatively impacting their conditioning properties by selecting a pH value between the $pK_a$ of coconut oil fatty acid, one of the anionic surfactant acids and the $pK_a$ of the amino or phosphino group that is used to quaternize the selected polymer.

TABLE 37

Formulation 35: Formulated to a pH of 10.0

| Ingredient | Percent in Formula (based on 100% active) |
|---|---|
| Phase A | |
| Alcohol ethoxylate | 6 |
| Fluorescent whitening agent | 0.158 |
| Main Mix | |
| Water | 55 |
| Sodium tetraborate pentahydrate | 3.0 |
| Sorbitol | 5.0 |
| Polymer LR 400[1] | 0.3 |
| Sodium hydroxide (50%) | 1.91 |
| Triethanolamine | 1.0 |
| Alkylbenzenesulfonic acid | 6.0 |
| Alkyl ethoxysulfate | 3.0 |
| Coconut oil fatty acid | 8 |
| Phase A | Added |
| Water | to 100 |
| PH | Adjusted to 10.0 with NaOH |

TABLE 38

Formulation 36: Formulated to a pH of 8.0

| Ingredient | Percent in Formula (based on 100% active) |
|---|---|
| Phase A | |
| Alcohol ethoxylate | 6 |
| Fluorescent whitening agent | 0.158 |
| Main Mix | |
| Water | 55 |
| Sodium tetraborate pentahydrate | 3.0 |
| Sorbitol | 5.0 |
| Polymer LR 400[1] | 0.3 |
| Sodium hydroxide (50%) | 1.91 |
| Triethanolamine | 1.0 |
| Alkylbenzenesulfonic acid | 6.0 |

TABLE 38-continued

Formulation 36: Formulated to a pH of 8.0

| Ingredient | Percent in Formula (based on 100% active) |
|---|---|
| Alkyl ethoxysulfate | 3.0 |
| Coconut oil fatty acid | 8 |
| Phase A | Added |
| Water | to 100 |
| PH | Adjusted to 8.0 with NaOH |

The $pK_a$ of trimethylamine, the amino group used to quaternize Polymer LR 400 is 9.8. Prior to pH adjustment, when the pH of the formulations was approximately 5, they were physically unstable, as the $pK_a$ of the fatty acid had not been reached.

All ingredients were added in the order specified in the tables. Phase A in each was made and kept at 140F until it was added at the point designated in the formula. Between additions, 5 minutes of constant mixing using an IKA RW 20 DZM.n mechanical stirrer equipped with a double-blade impeller took place to allow uniform blending to take place. After batching, the aroma of each product, in the neat form, was evaluated by a group of 5 expert panelists. All 5 of the panelists preferred the olfactory profile of Formulation 36 to that of Formulation 35, and identified an amine-type malodor coming from the latter product. The compositions were then tested for softening performance, the results of which are shown below in Table 37.

TABLE 39

Softening Results of Formulations 35 and 36

| Formulation | Softening Parameter |
|---|---|
| 35 | 96 |
| 36 | 113 |

As shown in the above data, softening performance is not negatively impacted in a substantial way by reducing the product pH to a value lower than the $Pk_a$ of trimethylamine, the amino group used to quaternize UCARE Polymer LR 400.

While the present invention has been described herein with some specificity, and with reference to certain preferred embodiments thereof, those of ordinary skill in the art will recognize numerous variations, modifications and substitutions of that which has been described which can be made, and which are within the scope and spirit of the invention. It is intended that all of these modifications and variations be within the scope of the present invention as described and claimed herein, and that the inventions be limited only by the scope of the claims which follow, and that such claims be interpreted as broadly as is reasonable. Throughout this application, various publications have been cited. The entireties of each of these publications are hereby incorporated by reference herein.

What is claimed is:

1. A liquid laundry composition consisting essentially of one or more cationic polymers and one or more anionic surfactants having an HLB of greater than 4, wherein the composition has a percent transmittance of greater than about 50 at 570 nanometers measured in the absence of dyes and contains less than about 2% anionic polysaccharide; wherein at least one anionic surfactant is selected from the group consisting of alkali and alkaline earth metal salts of fatty carboxylic acids, alkali and alkaline earth metal salts of alkylbenzene sulfonates.

2. The composition according to claim 1 wherein the composition comprises less than 10% phosphate and less than 10% zeolite.

3. The composition according to claim 1 wherein at least one cationic polymer is selected from the group consisting of dimethyl diallyl ammonium chloride/acrylamide copolymers, dimethyl diallyl ammonium chloride/acrylic acid/acrylamide terpolymers, vinylpyrrolidone/methyl vinyl imidazolium chloride copolymers, polydimethyl diallyl ammonium chloride, starch hydroxypropyl trimmonium chloride, polymethacryl amidopropyl trimethyl ammonium chloride, acrylamidopropyl trimmonium chloride/acrylamide copolymers, guar hydroxypropyl trimonium chloride, and hydroxyethyl cellulose derivatized with trimethyl ammonium substituted epoxide.

4. The composition according to claim 1 wherein said cationic polymer and said anionic surfactant are present at a ratio of less than about 1:4.

5. A laundry composition comprising one or more cationic polymers and more than about 5% of one or more anionic surfactants having an HLB of greater than about 4 and having a Softening Parameter of greater than about 40.

6. The composition according to claim 5, wherein at least one cationic polymer is selected from the group consisting of dimethyl diallyl ammonium chloride/acrylamide copolymers, dimethyl diallyl ammonium chloride/acrylic acid/acrylamide terpolymers, vinylpyrrolidone/methyl vinyl imidazolium chloride copolymers, polydimethyl diallyl ammonium chloride, starch hydroxypropyl trimmonium chloride, polymethacryl amidopropyl trimethyl ammonium chloride, acrylamidopropyl trimmonium chloride/acrylamide copolymers, guar hydroxypropyl trimonium chloride, and hydroxyethyl cellulose derivatized with trimethyl ammonium substituted epoxide.

7. The composition according to claim 5, wherein at least one cationic polymer is a cationic substituted siloxane or polyquaternium 10.

8. The composition according to claim 5, wherein one or more of the cationic polymers have a nitrogen content of less than about 2%.

9. The composition according to claim 5, wherein one or more cationic polymers have a molecular weight of less than about 850,000 daltons.

10. The composition according to claim 5, wherein at least one anionic surfactant is selected from the group consisting of alkali and alkaline earth metal salts of fatty carboxylic acids, alkali and alkaline earth metal salts of alkylbenzene sulfonates.

11. The composition according to claim 5, wherein the composition is selected from the group consisting of a liquid laundry detergent, a liquid fabric softener, a powder, paste, granule, molded solid, water soluble sheet and water soluble sachet.

12. The composition according to claim 5, wherein said composition is a liquid or paste having a pH below the pKa of an amine or phosphine used to quaternize one or more of the cationic polymers.

13. The composition according to claim 5, wherein the composition is diluted in use by more than a weight ratio of about 1:100 with water or solvent.

14. The composition according to claim 5, wherein said composition is a powder and said one or more cationic polymers have a dissolution parameter of 55 or greater.

15. A method for conditioning textiles comprising, in no particular order, the steps of:

a. providing a laundry detergent or fabric softener composition according to claim 6 in concentration to effectively soften and condition fabrics under predetermined laundering conditions;

b. contacting one or more articles with the composition at one or more points during a laundering process; and c. allowing the articles to dry or mechanically tumble-drying them.

16. The method according to claim 15, wherein one or more cationic polymers in said composition have a molecular weight of less than about 850,000 daltons.

17. The method according to claim 15, wherein the detergent or fabric softener composition is diluted by a weight ratio of more than about 1:100 with water or solvent.

18. The method according to claim 15, wherein at least one cationic polymer is selected from the group consisting of dimethyl diallyl ammonium chloride/acrylamide copolymers, dimethyl diallyl ammonium chloride/acrylic acid/acrylamide terpolymers, vinylpyrrolidone/methyl vinyl imidazolium chloride copolymers, polydimethyl diallyl ammonium chloride, starch hydroxypropyl trimmonium chloride, polymethacryl amidopropyl trimethyl ammonium chloride, acrylamidopropyl trimmonium chloride/acrylamide copolymers, guar hydroxypropyl trimonium chloride, and hydroxyethyl cellulose derivatized with trimethyl ammonium substituted epoxide.

19. The method according to claim 15, wherein at least one anionic surfactant is selected from the group consisting of alkali and alkaline earth metal salts of fatty carboxylic acids, alkali and alkaline earth metal salts of alkylbenzene sulfonates.

20. The method according to claim 15, wherein at least one cationic polymer is a cationic substituted siloxane.

21. The method according to claim 15, wherein the composition is a liquid laundry detergent or a liquid fabric softener.

22. The method according to claim 21, wherein the composition comprises less than about 2% anionic polysaccharide, less than 10% phosphate, less than 10% zeolite, and has a percent transmittance that is greater than about 50 at 570 nanometers measured in the absence of dyes.

23. The method according to claim 15, wherein the composition is a powder, paste, granule, molded solid, water soluble sheet or water soluble sachet.

24. The method according to claim 15, wherein said composition is a powder comprising one or more cationic polymers having a dissolution parameter of 55 or greater.

25. The method according to claim 15, wherein said composition is a liquid or paste having a pH below the pKa of an amine or phosphine used to quaternize one or more of the cationic polymers.

* * * * *